US006581398B2

(12) United States Patent
Wightman

(10) Patent No.: US 6,581,398 B2
(45) Date of Patent: Jun. 24, 2003

(54) VAPOR COMPRESSION SYSTEM AND METHOD

(75) Inventor: David A. Wightman, Arlington Heights, IL (US)

(73) Assignee: XDX Inc., Arlington Heights, IL (US)

( * ) Notice: Subject to any disclaimer, the term of this patent is extended or adjusted under 35 U.S.C. 154(b) by 0 days.

(21) Appl. No.: 09/902,900

(22) Filed: Jul. 10, 2001

(65) Prior Publication Data

US 2002/0053218 A1 May 9, 2002

Related U.S. Application Data

(63) Continuation of application No. PCT/US00/00663, filed on Jan. 11, 2001, which is a continuation-in-part of application No. 09/228,696, filed on Jan. 12, 1999, now Pat. No. 6,185,958, which is a continuation-in-part of application No. 09/431,830, filed on Nov. 2, 1999, which is a continuation-in-part of application No. 09/443,071, filed on Nov. 18, 1999.

(51) Int. Cl.[7] ..... F25B 41/04
(52) U.S. Cl. ..... 62/222; 236/92 B
(58) Field of Search ..... 62/204, 205, 210, 62/211, 212, 222, 223, 224, 225; 236/92 B

(56) References Cited

U.S. PATENT DOCUMENTS

| | | | | |
|---|---|---|---|---|
| 1,907,885 A | | 5/1933 | Shively | |
| 2,084,755 A | | 6/1937 | Young, Jr. | |
| 2,112,039 A | | 3/1938 | McLenegan | |
| 2,126,364 A | | 8/1938 | Witzel | |
| 2,164,761 A | * | 7/1939 | Ashley | 62/117 |
| 2,200,118 A | | 5/1940 | Miller | |
| 2,229,940 A | | 1/1941 | Spofford | |
| 2,323,408 A | | 7/1943 | Miller | |
| 2,467,519 A | | 4/1949 | Borghesan | |
| 2,471,448 A | | 5/1949 | Platon | |
| 2,511,565 A | * | 6/1950 | Carter | 62/212 |
| 2,520,191 A | | 8/1950 | Aughey et al. | |

(List continued on next page.)

FOREIGN PATENT DOCUMENTS

| | | |
|---|---|---|
| DE | 197 52 259 A1 | 6/1998 |
| DE | 197 43 734 A1 | 4/1999 |
| EP | 0 355 180 A2 | 2/1990 |

(List continued on next page.)

OTHER PUBLICATIONS

03304466; Hiroshi et al.; Air Conditioner; Nov. 15, 1990; Pub. No. 02–279966; p. 156.

(List continued on next page.)

*Primary Examiner*—Harry B. Tanner
(74) *Attorney, Agent, or Firm*—Brinks Hofer Gilson & Lione

(57) ABSTRACT

A vapor compression system includes an evaporator, a compressor, and a condenser interconnected in a closed-loop system. In one embodiment, a multifunctional valve is configured to receive a liquefied heat transfer fluid from the condenser and a hot vapor from the compressor. A saturated vapor line connects the outlet of the multifunctional valve to the inlet of the evaporator and is sized so as to substantially convert the heat transfer fluid exiting the multifunctional valve into a saturated vapor prior to delivery to the evaporator. The multifunctional valve regulates the flow of heat transfer fluid through the valve by monitoring the temperature of the heat transfer fluid returning to the compressor through a suction line coupling the outlet of the evaporator to the inlet of the compressor. Separate gated passageways within the multifunctional valve permit the refrigeration system to be operated in defrost mode by flowing hot vapor through the saturated vapor line and the evaporator in a forward-flow process thereby reducing the amount of time necessary to defrost the system and improving the overall system performance.

22 Claims, 10 Drawing Sheets

U.S. PATENT DOCUMENTS

| | | | | |
|---|---|---|---|---|
| 2,539,062 | A | | 1/1951 | Dillman |
| 2,547,070 | A | | 4/1951 | Aughey et al. |
| 2,571,625 | A | | 10/1951 | Seldon |
| 2,596,036 | A | * | 5/1952 | MacDougall ..... 62/225 X |
| 2,707,868 | A | | 5/1955 | Goodman |
| 2,755,025 | A | | 7/1956 | Boles |
| 2,771,092 | A | | 11/1956 | Schenk |
| 2,856,759 | A | | 10/1958 | Barbulesco |
| 2,922,292 | A | | 1/1960 | Lange |
| 2,944,411 | A | | 7/1960 | McGrath |
| 2,960,845 | A | | 11/1960 | Lange |
| 3,007,681 | A | | 11/1961 | Keller |
| 3,014,351 | A | | 12/1961 | Leimbach |
| 3,060,699 | A | | 10/1962 | Tilney |
| 3,138,007 | A | | 6/1964 | Friedman et al. |
| 3,150,498 | A | | 9/1964 | Blake |
| 3,194,499 | A | | 7/1965 | Noakes et al. |
| 3,257,822 | A | | 6/1966 | Abbott |
| 3,316,731 | A | | 5/1967 | Quick |
| 3,343,375 | A | | 9/1967 | Quick |
| 3,392,542 | A | | 7/1968 | Nussbaum |
| 3,402,566 | A | | 9/1968 | Leimbach |
| 3,427,819 | A | | 2/1969 | Seghetti |
| 3,464,226 | A | | 9/1969 | Kramer |
| 3,520,147 | A | | 7/1970 | Glackman |
| 3,631,686 | A | | 1/1972 | Kautz |
| 3,633,378 | A | | 1/1972 | Toth |
| 3,638,444 | A | | 2/1972 | Lindahl |
| 3,638,447 | A | | 2/1972 | Abe |
| 3,683,637 | A | | 8/1972 | Oshima et al. |
| 3,708,998 | A | | 1/1973 | Scherer et al. |
| 3,727,423 | A | | 4/1973 | Nielson |
| 3,785,163 | A | | 1/1974 | Wagner |
| 3,792,594 | A | | 2/1974 | Kramer |
| 3,798,920 | A | | 3/1974 | Morgan |
| 3,822,562 | A | | 7/1974 | Crosby |
| 3,866,427 | A | | 2/1975 | Rothmayer et al. |
| 3,921,413 | A | | 11/1975 | Kohlbeck |
| 3,927,829 | A | * | 12/1975 | Willner et al. ..... 236/92 B |
| 3,934,424 | A | | 1/1976 | Goldsberry |
| 3,934,426 | A | | 1/1976 | Jespersen et al. |
| 3,948,060 | A | | 4/1976 | Gaspard |
| 3,965,693 | A | | 6/1976 | Widdowson |
| 3,967,466 | A | | 7/1976 | Edwards |
| 3,967,782 | A | | 7/1976 | Eschbaugh et al. |
| 3,968,660 | A | | 7/1976 | Amann et al. |
| 3,980,129 | A | | 9/1976 | Bergdahl |
| 4,003,729 | A | | 1/1977 | McGrath |
| 4,003,798 | A | | 1/1977 | McCord |
| 4,006,601 | A | | 2/1977 | Ballarin et al. |
| 4,103,508 | A | | 8/1978 | Apple |
| 4,106,691 | A | | 8/1978 | Nielsen |
| 4,122,686 | A | | 10/1978 | Lindahl et al. |
| 4,122,688 | A | | 10/1978 | Mochizuki et al. |
| 4,136,528 | A | | 1/1979 | Vogel et al. |
| 4,151,722 | A | | 5/1979 | Willitts et al. |
| 4,163,373 | A | | 8/1979 | van der Sluijs |
| 4,167,102 | A | | 9/1979 | Willitts |
| 4,176,525 | A | | 12/1979 | Tucker et al. |
| 4,182,133 | A | | 1/1980 | Haas et al. |
| 4,184,341 | A | | 1/1980 | Friedman |
| 4,193,270 | A | | 3/1980 | Scott |
| 4,207,749 | A | | 6/1980 | Lavigne, Jr. |
| 4,230,470 | A | | 10/1980 | Matsuda et al. |
| 4,235,079 | A | | 11/1980 | Masser |
| 4,270,362 | A | | 6/1981 | Lancia et al. |
| 4,285,205 | A | | 8/1981 | Martin et al. |
| 4,290,480 | A | | 9/1981 | Sulkowski |
| 4,302,945 | A | | 12/1981 | Bell |
| 4,328,682 | A | | 5/1982 | Vana |
| 4,350,021 | A | | 9/1982 | Lundstrom |
| 4,398,396 | A | | 8/1983 | Schmerzler |
| 4,430,866 | A | | 2/1984 | Willitts |
| 4,451,273 | A | | 5/1984 | Cheng et al. |
| 4,485,642 | A | | 12/1984 | Karns |
| 4,493,364 | A | | 1/1985 | Macriss et al. |
| 4,543,802 | A | | 10/1985 | Ingelmann et al. |
| 4,583,582 | A | | 4/1986 | Grossman |
| 4,596,123 | A | | 6/1986 | Cooperman |
| 4,606,198 | A | | 8/1986 | Latshaw et al. |
| 4,621,505 | A | | 11/1986 | Ares et al. |
| 4,633,681 | A | | 1/1987 | Webber |
| 4,658,596 | A | | 4/1987 | Kuwahara |
| 4,660,385 | A | | 4/1987 | Macriss et al. |
| 4,742,694 | A | | 5/1988 | Yamanaka et al. |
| 4,779,425 | A | | 10/1988 | Sasaki et al. |
| 4,809,518 | A | * | 3/1989 | Murayama ..... 62/225 |
| 4,813,474 | A | | 3/1989 | Umezu |
| 4,848,100 | A | | 7/1989 | Barthel et al. |
| 4,852,364 | A | | 8/1989 | Seener et al. |
| 4,854,130 | A | | 8/1989 | Naruse et al. |
| 4,888,957 | A | | 12/1989 | Chmielewski |
| 4,938,032 | A | | 7/1990 | Mudford |
| 4,942,740 | A | | 7/1990 | Shaw et al. |
| 4,947,655 | A | | 8/1990 | Shaw |
| 4,955,205 | A | | 9/1990 | Wilkinson |
| 4,955,207 | A | | 9/1990 | Mink |
| 4,979,372 | A | | 12/1990 | Tanaka |
| 4,984,433 | A | | 1/1991 | Worthington |
| 5,050,393 | A | | 9/1991 | Bryant |
| 5,058,388 | A | | 10/1991 | Shaw et al. |
| 5,062,276 | A | | 11/1991 | Dudley |
| 5,065,591 | A | | 11/1991 | Shaw |
| 5,070,707 | A | | 12/1991 | Ni |
| 5,072,597 | A | | 12/1991 | Bromley et al. |
| 5,076,068 | A | | 12/1991 | Mikhail |
| 5,094,598 | A | | 3/1992 | Amata et al. |
| 5,107,906 | A | | 4/1992 | Swenson et al. |
| 5,129,234 | A | | 7/1992 | Alford |
| 5,131,237 | A | | 7/1992 | Valbjorn |
| 5,168,715 | A | | 12/1992 | Nakao et al. |
| 5,181,552 | A | | 1/1993 | Eiermann |
| 5,195,331 | A | | 3/1993 | Zimmern et al. |
| 5,231,845 | A | | 8/1993 | Sumitani et al. |
| 5,249,433 | A | | 10/1993 | Hardison et al. |
| 5,251,459 | A | | 10/1993 | Grass et al. |
| 5,253,482 | A | | 10/1993 | Murway |
| 5,291,941 | A | | 3/1994 | Enomoto et al. |
| 5,303,561 | A | | 4/1994 | Bahel et al. |
| 5,305,610 | A | | 4/1994 | Bennett et al. |
| 5,309,725 | A | | 5/1994 | Cayce |
| 5,329,781 | A | | 7/1994 | Farrey et al. |
| 5,355,323 | A | | 10/1994 | Bae |
| 5,377,498 | A | | 1/1995 | Cur et al. |
| 5,408,835 | A | | 4/1995 | Anderson |
| 5,423,480 | A | | 6/1995 | Heffner et al. |
| 5,440,894 | A | | 8/1995 | Schaeffer et al. |
| 5,509,272 | A | | 4/1996 | Hyde |
| 5,515,695 | A | | 5/1996 | Sakakibara et al. |
| 5,520,004 | A | | 5/1996 | Jones, III |
| 5,544,809 | A | | 8/1996 | Keating et al. |
| 5,586,441 | A | | 12/1996 | Wilson et al. |
| 5,597,117 | A | | 1/1997 | Watanabe et al. |
| 5,598,715 | A | | 2/1997 | Edmisten |
| 5,615,560 | A | | 4/1997 | Inoue |
| 5,622,055 | A | | 4/1997 | Mei et al. |
| 5,622,057 | A | | 4/1997 | Bussjager et al. |
| 5,634,355 | A | | 6/1997 | Cheng et al. |
| 5,651,258 | A | | 7/1997 | Harris |
| 5,678,417 | A | | 10/1997 | Nigo et al. |
| 5,689,962 | A | | 11/1997 | Rafalovich |

| | | | |
|---|---|---|---|
| 5,692,387 | A | 12/1997 | Alsenz et al. |
| 5,694,782 | A | 12/1997 | Alsenz |
| 5,706,665 | A | 1/1998 | Gregory |
| 5,706,666 | A | 1/1998 | Yamanaka et al. |
| 5,743,100 | A | 4/1998 | Welguisz et al. |
| 5,752,390 | A | 5/1998 | Hyde |
| 5,765,391 | A | 6/1998 | Lee et al. |
| 5,806,321 | A | 9/1998 | Bendtsen et al. |
| 5,813,242 | A | 9/1998 | Lawrence et al. |
| 5,826,438 | A | 10/1998 | Ohishi et al. |
| 5,839,505 | A | 11/1998 | Ludwig et al. |
| 5,842,352 | A | 12/1998 | Gregory |
| 5,845,511 | A | 12/1998 | Okada et al. |
| 5,850,968 | A | 12/1998 | Jokinen |
| 5,862,676 | A | 1/1999 | Kim et al. |
| 5,867,998 | A | 2/1999 | Guertin |
| 5,887,651 | A | 3/1999 | Meyer |
| 5,964,099 | A | 10/1999 | Kim |
| 5,987,916 | A | 11/1999 | Egbert |
| 6,185,958 | B1 | 2/2001 | Wightman |
| 6,318,118 | B2 | 11/2001 | Hanson et al. |

FOREIGN PATENT DOCUMENTS

| | | |
|---|---|---|
| JP | 58146778 | 9/1983 |
| JP | 03020577 | 1/1991 |
| JP | 10325630 | 8/1998 |
| JP | 10306958 | 11/1998 |
| WO | WO 93/06422 | 4/1993 |
| WO | WO 95/03515 | 2/1995 |
| WO | WO 98/03827 | 1/1998 |
| WO | WO 98/57104 | 12/1998 |

OTHER PUBLICATIONS

02979575; Tadashi et al.; Refrigerating Cycle; Nov. 7, 1989; Pub. No. 01–277175; p. 46.

04001275; Tomomi et al.; Air Conditioner; Dec. 18, 1992; Pub. No. 04–366375; p. 69.

Kominkiewicz, Frank, Memo, dated Feb. 17, 2000, Subject "Tecogen Chiller", 6 pages.

Vienna–Tyler Dec. Case, Memo, dated Feb. 25, 2000, Compressor Model D6VD12, Serial N159282.

* cited by examiner-

VAPOR COMPRESSION SYSTEM AND METHOD

This application is a continuation of pending International Application Number PCT/US00/00663, filed Jan. 11, 2001, entitled "Vapor Compression System and Method", the disclosure of which is hereby incorporated by reference. International Application Number PCT/US00/00663 is a continuation-in-part of the following applications: pending U.S. patent application Ser. No. 09/228,696, filed Jan. 12, 1999, entitled "Vapor Compression System and Method"; issued U.S. Pat. No. 6,185,958, Ser. No. 09/431,830, filed Nov. 2, 1999, entitled "Vapor Compression System and Method"; and pending U.S. patent application Ser. No. 09/443,071, filed Nov. 18, 1999 entitled "Vapor Compression System and Method", the disclosures of which are hereby incorporated by reference.

FIELD OF THE INVENTION

This invention relates, generally, to vapor compression systems, and more particularly, to mechanically-controlled refrigeration systems using forward-flow defrost cycles.

BACKGROUND OF THE INVENTION

In a closed-loop vapor compression cycle, the heat transfer fluid changes state from a vapor to a liquid in the condenser, giving off heat, and changes state from a liquid to a vapor in the evaporator, absorbing heat during vaporization. A typical vapor-compression refrigeration system includes a compressor for pumping a heat transfer fluid, such as a freon, to a condenser, where heat is given off as the vapor condenses into a liquid. The liquid flows through a liquid line to a thermostatic expansion valve, where the heat transfer fluid undergoes a volumetric expansion. The heat transfer fluid exiting the thermostatic expansion valve is a low quality liquid vapor mixture. As used herein, the term "low quality liquid vapor mixture" refers to a low pressure heat transfer fluid in a liquid state with a small presence of flash gas that cools off the remaining heat transfer fluid, as the heat transfer fluid continues on in a sub-cooled state. The expanded heat transfer fluid then flows into an evaporator, where the liquid refrigerant is vaporized at a low pressure absorbing heat while it undergoes a change of state from a liquid to a vapor. The heat transfer fluid, now in the vapor state, flows through a suction line back to the compressor. Sometimes, the heat transfer fluid exits the evaporator not in a vapor state, but rather in a superheated vapor state.

In one aspect, the efficiency of the vapor-compression cycle depends upon the ability of the system to maintain the heat transfer fluid as a high pressure liquid upon exiting the condenser. The cooled, high-pressure liquid must remain in the liquid state over the long refrigerant lines extending between the condenser and the thermostatic expansion valve. The proper operation of the thermostatic expansion valve depends upon a certain volume of liquid heat transfer fluid passing through the valve. As the high-pressure liquid passes through an orifice in the thermostatic expansion valve, the fluid undergoes a pressure drop as the fluid expands through the valve. At the lower pressure, the fluid cools an additional amount as a small amount of flash gas forms and cools of the bulk of the heat transfer fluid that is in liquid form. As used herein, the term "flash gas" is used to describe the pressure drop in an expansion device, such as a thermostatic expansion valve, when some of the liquid passing through the valve is changed quickly to a gas and cools the remaining heat transfer fluid that is in liquid form to the corresponding temperature.

This low quality liquid vapor mixture passes into the initial portion of cooling coils within the evaporator. As the fluid progresses through the coils, it initially absorbs a small amount of heat while it warms and approaches the point where it becomes a high quality liquid vapor mixture. As used herein, the term "high quality liquid vapor mixture" refers to a heat transfer fluid that resides in both a liquid state and a vapor state with matched enthalpy, indicating the pressure and temperature of the heat transfer fluid are in correlation with each other. A high quality liquid vapor mixture is able to absorb heat very efficiently since it is in a change of state condition. The heat transfer fluid then absorbs heat from the ambient surroundings and begins to boil. The boiling process within the evaporator coils produces a saturated vapor within the coils that continues to absorb heat from the ambient surroundings. Once the fluid is completely boiled-off, it exits through the final stages of the cooling coil as a cold vapor. Once the fluid is completely converted to a cold vapor, it absorbs very little heat. During the final stages of the cooling coil, the heat transfer fluid enters a superheated vapor state and becomes a superheated vapor. As defined herein, the heat transfer fluid becomes a "superheated vapor" when minimal heat is added to the heat transfer fluid while in the vapor state, thus raising the temperature of the heat transfer fluid above the point at which it entered the vapor state while still maintaining a similar pressure. The superheated vapor is then returned through a suction line to the compressor, where the vapor-compression cycle continues.

For high-efficiency operation, the heat transfer fluid should change state from a liquid to a vapor in a large portion of the cooling coils within the evaporator. As the heat transfer fluid changes state from a liquid to a vapor, it absorbs a great deal of energy as the molecules change from a liquid to a gas absorbing a latent heat of vaporization. In contrast, relatively little heat is absorbed while the fluid is in the liquid state or while the fluid is in the vapor state. Thus, optimum cooling efficiency depends on precise control of the heat transfer fluid by the thermostatic expansion valve to insure that the fluid undergoes a change of state in as large of cooling coil length as possible. When the heat transfer fluid enters the evaporator in a cooled liquid state and exits the evaporator in a vapor state or a superheated vapor state, the cooling efficiency of the evaporator is lowered since a substantial portion of the evaporator contains fluid that is in a state which absorbs very little heat. For optimal cooling efficiency, a substantial portion, or an entire portion, of the evaporator should contain fluid that is in both a liquid state and a vapor state. To insure optimal cooling efficiency, the heat transfer fluid entering and exiting from the evaporator should be a high quality liquid vapor mixture.

The thermostatic expansion valve plays an important role and regulating the flow of heat transfer fluid through the closed-loop system. Before any cooling effect can be produced in the evaporator, the heat transfer fluid has to be cooled from the high-temperature liquid exiting the condenser to a range suitable of an evaporating temperature by a drop in pressure. The flow of low pressure liquid to the evaporator is metered by the thermostatic expansion valve in an attempt to maintain maximum cooling efficiency in the evaporator. Typically, once operation has stabilized, a mechanical thermostatic expansion valve regulates the flow of heat transfer fluid by monitoring the temperature of the heat transfer fluid in the suction line near the outlet of the evaporator. The heat transfer fluid upon exiting the thermostatic expansion valve is in the form of a low pressure liquid having a small amount of flash gas. The presence of flash gas provides a cooling affect upon the balance of the heat transfer fluid in its liquid state, thus creating a low quality liquid vapor mixture. A temperature sensor is attached to the suction line to measure the amount of superheating experienced by the heat transfer fluid as it exits from the evaporator. Superheat is the amount of heat added to the vapor, after the heat transfer fluid has completely boiled-off and liquid no longer remains in the suction line. Since very little heat is absorbed by the superheated vapor, the thermostatic expansion valve meters the flow of heat transfer fluid to minimize the amount of superheated vapor formed in the evaporator. Accordingly, the thermostatic expansion valve determines the amount of low-pressure liquid flowing into the evaporator by monitoring the degree of superheating of the vapor exiting from the evaporator.

In addition to the need to regulate the flow of heat transfer fluid through the closed-loop system, the optimum operating efficiency of the refrigeration system depends upon periodic defrost of the evaporator. Periodic defrosting of the evaporator is needed to remove icing that develops on the evaporator coils during operation. As ice or frost develops over the evaporator, it impedes the passage of air over the evaporator coils reducing the heat transfer efficiency. In a commercial system, such as a refrigerated display cabinet, the build up of frost can reduce the rate of air flow to such an extent that an air curtain cannot form in the display cabinet. In commercial systems, such as food chillers, and the like, it is often necessary to defrost the evaporator every few hours. Various defrosting methods exist, such as off-cycle methods, where the refrigeration cycle is stopped and the evaporator is defrosted by air at ambient temperatures. Additionally, electrical defrost off-cycle methods are used, where electrical heating elements are provided around the evaporator and electrical current is passed through the heating coils to melt the frost.

In addition to off-cycle defrost systems, refrigeration systems have been developed that rely on the relatively high temperature of the heat transfer fluid exiting the compressor to defrost the evaporator. In these techniques, the high-temperature vapor is routed directly from the compressor to the evaporator. In one technique, the flow of high temperature vapor is dumped into the suction line and the system is essentially operated in reverse. In other techniques, the high-temperature vapor is pumped into a dedicated line that leads directly from the compressor to the evaporator for the sole purpose of conveying high-temperature vapor to periodically defrost the evaporator. Additionally, other complex methods have been developed that rely on numerous devices within the refrigeration system, such as bypass valves, bypass lines, heat exchangers, and the like.

In an attempt to obtain better operating efficiency from conventional vapor-compression refrigeration systems, the refrigeration industry is developing systems of growing complexity. Sophisticated computer-controlled thermostatic expansion valves have been developed in an attempt to obtain better control of the heat transfer fluid through the evaporator. Additionally, complex valves and piping systems have been developed to more rapidly defrost the evaporator in order to maintain high heat transfer rates. While these systems have achieved varying levels of success, the system cost rises dramatically as the complexity of the system increases. Accordingly, a need exists for an efficient refrigeration system that can be installed at low cost and operated at high efficiency.

SUMMARY OF THE INVENTION

The present invention provides a refrigeration system that maintains high operating efficiency by feeding a saturated vapor into the inlet of an evaporator. As used herein, the term "saturated vapor" refers to a heat transfer fluid that resides in both a liquid state and a vapor state with matched enthalpy, indicating the pressure and temperature of the heat transfer fluid are in correlation with each other. Saturated vapor is a high quality liquid vapor mixture. By feeding saturated vapor to the evaporator, heat transfer fluid in both a liquid and a vapor state enters the evaporator coils. Thus, the heat transfer fluid is delivered to the evaporator in a physical state in which maximum heat can be absorbed by the fluid. In addition to high efficiency operation of the evaporator, in one preferred embodiment of the invention, the refrigeration system provides a simple means of defrosting the evaporator. A multifunctional valve is employed that contains separate passageways feeding into a common chamber. In operation, the multifunctional valve can transfer either a saturated vapor, for cooling, or a high temperature vapor, for defrosting, to the evaporator.

In one form, the vapor compression system includes an evaporator for evaporating a heat transfer fluid, a compressor for compressing the heat transfer fluid to a relatively high temperature and pressure, and a condenser for condensing the heat transfer fluid. A saturated vapor line is coupled from an expansion valve to the evaporator. In one preferred embodiment of the invention, the diameter and the length of the saturated vapor line is sufficient to insure substantial conversion of the heat transfer fluid into a saturated vapor prior to delivery of the fluid to the evaporator. In one preferred embodiment of the invention, a heat source is applied to the heat transfer fluid in the saturated vapor line sufficient to vaporize a portion of the heat transfer fluid before the heat transfer fluid enters the evaporator. In one preferred embodiment of the invention, a heat source is applied to the heat transfer fluid after the heat transfer fluid passes through the expansion valve and before the heat transfer fluid enters the evaporator. The heat source converts the heat transfer fluid from a low quality liquid vapor mixture to a high quality liquid vapor mixture, or a saturated vapor. Typically, at least about 5% of the heat transfer fluid is vaporized before entering the evaporator. In one embodiment of the invention, the expansion valve resides within a multifunctional valve that includes a first inlet for receiving the heat transfer fluid in the liquid state, and a second inlet for receiving the heat transfer fluid in the vapor state. The multifunctional valve further includes passageways coupling the first and second inlets to a common chamber. Gate valves position within the passageways enable the flow of heat transfer fluid to be independently interrupted in each passageway. The ability to independently control the flow of saturated vapor and high temperature vapor through the refrigeration system produces high operating efficiency by both increased heat transfer rates at the evaporator and by rapid defrosting of the evaporator. The increased operating efficiency enables the refrigeration system to be charged with relatively small amounts of heat transfer fluid, yet the refrigeration system can handle relatively large thermal loads.

DETAILED DESCRIPTION OF THE PREFERRED EMBODIMENTS

Figure 1:
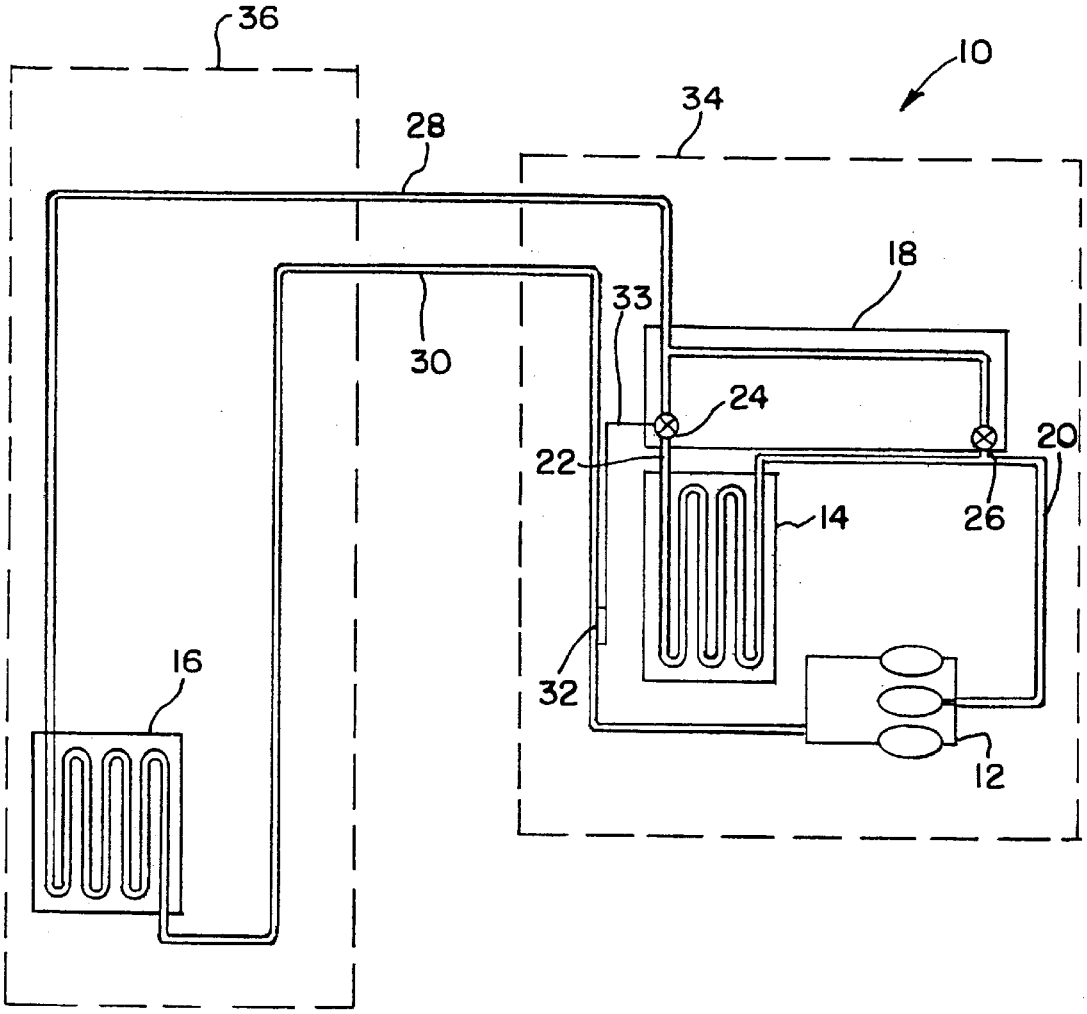
FIG. 1 is a schematic drawing of a vapor-compression system arranged in accordance with one embodiment of the invention.

An embodiment of a vapor-compression system 10 arranged in accordance with one embodiment of the invention is illustrated in FIG. 1. Refrigeration system 10 includes a compressor 12, a condenser 14, an evaporator 16, and a multifunctional valve 18. Compressor 12 is coupled to condenser 14 by a discharge line 20. Multifunctional valve 18 is coupled to condenser 14 by a liquid line 22 coupled to a first inlet 24 of multifunctional valve 18. Additionally, multifunctional valve 18 is coupled to discharge line 20 at a second inlet 26. A saturated vapor line 28 couples multifunctional valve 18 to evaporator 16, and a suction line 30 couples the outlet of evaporator 16 to the inlet of compressor 12. A temperature sensor 32 is mounted to suction line 30 and is operably connected to multifunctional valve 18. In accordance with the invention, compressor 12, condenser 14, multifunctional valve 18 and temperature sensor 32 are located within a control unit 34. Correspondingly, evaporator 16 is located within a refrigeration case 36. In one preferred embodiment of the invention, compressor 12, condenser 14, multifunctional valve 18, temperature sensor 32 and evaporator 16 are all located within a refrigeration case 36. In another preferred embodiment of the invention, the vapor compression system comprises control unit 34 and refrigeration case 36, wherein compressor 12 and condenser 14 are located within the control unit 34, and wherein evaporator 16, multifunctional valve 18, and temperature sensor 32 are located within refrigeration case 36.

The vapor compression system of the present invention can utilize essentially any commercially available heat transfer fluid including refrigerants such as, for example, chlorofluorocarbons such as R-12 which is a dicholordifluoromethane, R-22 which is a monochlorodifluoromethane, R-500 which is an azeotropic refrigerant consisting of R-12 and R-152a, R-503 which is an azeotropic refrigerant consisting of R-23 and R-13, and R-502 which is an azeotropic refrigerant consisting of R-22 and R-115. The vapor compression system of the present invention can also utilize refrigerants such as, but not limited to refrigerants R-13, R-113, 141b, 123a, 123, R-114, and R-11. Additionally, the vapor compression system of the present invention can utilize refrigerants such as, for example, hydrochlorofluorocarbons such as 141b, 123a, 123, and 124, hydrofluorocarbons such as R-134a, 134, 152, 143a, 125, 32, 23, and azeotropic HFCs such as AZ-20 and AZ-50 (which is commonly known as R-507). Blended refrigerants such as MP-39, HP-80, FC-14, R-717, and HP-62 (commonly known as R-404a), may also be used as refrigerants in the vapor compression system of the present invention. Accordingly, it should be appreciated that the particular refrigerant or combination of refrigerants utilized in the present invention is not deemed to be critical to the operation of the present invention since this invention is expected to operate with a greater system efficiency with virtually all refrigerants than is achievable by any previously known vapor compression system utilizing the same refrigerant.

In operation, compressor 12 compresses the heat transfer fluid, to a relatively high pressure and temperature. The temperature and pressure to which the heat transfer fluid is compressed by compressor 12 will depend upon the particular size of refrigeration system 10 and the cooling load requirements of the systems. Compressor 12 pumps the heat transfer fluid into discharge line 20 and into condenser 14. As will be described in more detail below, during cooling operations, second inlet 26 is closed and the entire output of compressor 12 is pumped through condenser 14.

In condenser 14, a medium such as air, water, or a secondary refrigerant is blown past coils within the condenser causing the pressurized heat transfer fluid to change to the liquid state. The temperature of the heat transfer fluid drops about 10 to 40° F. (5.6 to 22.2° C.), depending on the particular heat transfer fluid, or glycol, or the like, as the latent heat within the fluid is expelled during the condensation process. Condenser 14 discharges the liquefied heat transfer fluid to liquid line 22. As shown in FIG. 1, liquid line 22 immediately discharges into multifunctional valve 18. Because liquid line 22 is relatively short, the pressurized liquid carried by liquid line 22 does not substantially increase in temperature as it passes from condenser 14 to multifunctional valve 18. By configuring refrigeration system 10 to have a short liquid line, refrigeration system 10 advantageously delivers substantial amounts of heat transfer fluid to multifunctional valve 18 at a low temperature and high pressure. Since the fluid does not travel a great distance once it is converted to a high-pressure liquid, little heat absorbing capability is lost by the inadvertent warming of the liquid before it enters multifunctional valve 18, or by a loss of in liquid pressure. While in the above embodiments of the invention, the refrigeration system uses a relatively short liquid line 22, it is possible to implement the advantages of the present invention in a refrigeration system using a relatively long liquid line 22, as will be described below. The heat transfer fluid discharged by condenser 14 enters multifunctional valve 18 at first inlet 22 and undergoes a volumetric expansion at a rate determined by the temperature of suction line 30 at temperature sensor 32. Multifunctional valve 18 discharges the heat transfer fluid as a saturated vapor into saturated vapor line 28. Temperature sensor 32 relays temperature information through a control line 33 to multifunctional valve 18.

Those skilled in the art will recognize that refrigeration system 10 can be used in a wide variety of applications for controlling the temperature of an enclosure, such as a refrigeration case in which perishable food items are stored. For example, where refrigeration system 10 is employed to control the temperature of a refrigeration case having a cooling load of about 12000 Btu/hr (84 g cal/s), compressor 12 discharges about 3 to 5 lbs/min (1.36 to 2.27 kg/min) of R-12 at a temperature of about 110° F. (43.3° C.) to about 120° F. (48.9° C.) and a pressure of about 150 lbs/in$^2$ (1.03 E5 N/m$^2$) to about 180 lbs/in.$^2$ (1.25 E5 N/m$^2$).

In accordance with one preferred embodiment of the invention, saturated vapor line 28 is sized in such a way that the low pressure fluid discharged into saturated vapor line 28 substantially converts to a saturated vapor as it travels through saturated vapor line 28. In one embodiment, saturated vapor line 28 is sized to handle about 2500 ft/min (76 m/min) to 3700 ft/min (1128 m/min) of a heat transfer fluid, such as R-12, and the like, and has a diameter of about 0.5 to 1.0 inches (1.27 to 2.54 cm), and a length of about 90 to 100 feet (27 to 30.5 m). As described in more detail below, multifunctional valve 18 includes a common chamber immediately before the outlet. The heat transfer fluid undergoes an additional volumetric expansion as it enters the common chamber. The additional volumetric expansion of the heat transfer fluid in the common chamber of multifunctional valve 18 is equivalent to an effective increase in the line size of saturated vapor line 28 by about 225%.

Those skilled in the art will further recognize that the positioning of a valve for volumetrically expanding of the heat transfer fluid in close proximity to the condenser, and the relatively great length of the fluid line between the point of volumetric expansion and the evaporator, differs considerably from systems of the prior art. In a typical prior art system, an expansion valve is positioned immediately adjacent to the inlet of the evaporator, and if a temperature sensing device is used, the device is mounted in close proximity to the outlet of the evaporator. As previously described, such system can suffer from poor efficiency because substantial amounts of the evaporator carry a liquid rather than a saturated vapor. Fluctuations in high side pressure, liquid temperature, heat load or other conditions can adversely effect the evaporator's efficiency.

In contrast to the prior art, the inventive refrigeration system described herein positions a saturated vapor line between the point of volumetric expansion and the inlet of the evaporator, such that portions of the heat transfer fluid are converted to a saturated vapor before the heat transfer fluid enters the evaporator. By charging evaporator 16 with a saturated vapor, the cooling efficiency is greatly increased. By increasing the cooling efficiency of an evaporator, such as evaporator 16, numerous benefits are realized by the refrigeration system. For example, less heat transfer fluid is needed to control the air temperature of refrigeration case 36 at a desired level. Additionally, less electricity is needed to power compressor 12 resulting in lower operating cost. Further, compressor 12 can be sized smaller than a prior art system operating to handle a similar cooling load. Moreover, in one preferred embodiment of the invention, the refrigeration system avoids placing numerous components in proximity to the evaporator. By restricting the placement of components within refrigeration case 36 to a minimal number, the thermal loading of refrigeration case 36 is minimized.

Figure 7:
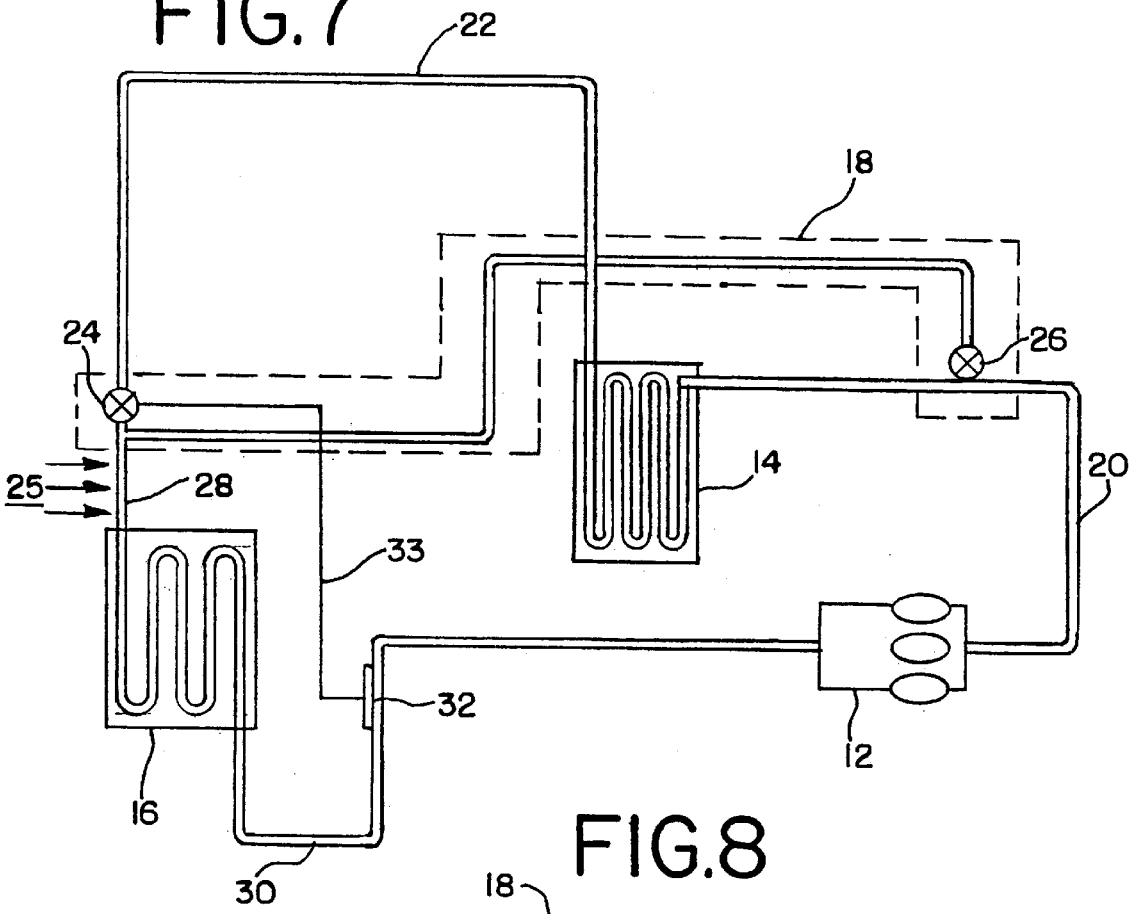
FIG. 7 is a schematic view of a vapor-compression system in accordance with yet another embodiment of the invention.
Figure 8:
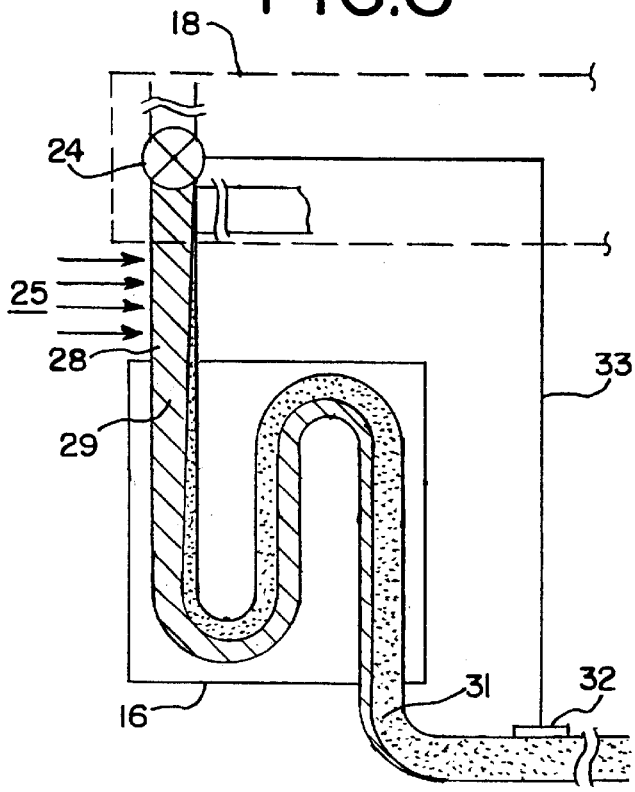
FIG. 8 is an enlarged cross-sectional view of a portion of the vapor compression system illustrated in FIG. 7.

While in the above embodiments of the invention, multifunctional valve 18 is positioned in close proximity to condenser 14, thus creating a relatively short liquid line 22 and a relatively long saturated vapor line 28, it is possible to implement the advantages of the present invention even if multifunctional valve 18 is positioned immediately adjacent to the inlet of the evaporator 16, thus creating a relatively long liquid line 22 and a relatively short saturated vapor line 28. For example, in one preferred embodiment of the invention, multifunctional valve 18 is positioned immediately adjacent to the inlet of the evaporator 16, thus creating a relatively long liquid line 22 and a relatively short saturated vapor line 28, as illustrated in FIG. 7. In order to insure that the heat transfer fluid entering evaporator 16 is a saturated vapor, a heat source 25 is applied to saturated vapor line 28, as illustrated in FIGS. 7–8. Temperature sensor 32 is mounted to suction line 30 and operatively connected to multifunctional valve 18, wherein heat source 25 is of sufficient intensity so as to vaporize a portion of the heat transfer fluid before the heat transfer fluid enters evaporator 16. The heat transfer fluid entering evaporator 16 is converted to a saturated vapor wherein a portion of the heat transfer fluids exists in a liquid state 29, and another portion of the heat transfer fluid exists in a vapor state 31, as illustrated in FIG. 8.

Preferably heat source 25 used to vaporize a portion of the heat transfer fluid comprises heat transferred to the ambient surroundings from condenser 14, however, heat source 25 can comprise any external or internal source of heat known to one of ordinary skill in the art, such as, for example, heat transferred to the ambient surroundings from the discharge line 20, heat transferred to the ambient surroundings from a compressor, heat generated by the compressor, heat generated from an electrical heat source, heat generated using combustible materials, heat generated using solar energy, or any other source of heat. Heat source 25 can also comprise an active heat source, that is, any heat source that is intentionally applied to a part of refrigeration system 10, such as saturated vapor line 28. An active heat source includes but is not limited to source of heat such as heat generated from an electrical heat source, heat generated using combustible materials, heat generated using solar energy, or any other source of heat which is intentionally and actively applied to any part of refrigeration system 10. A heat source that comprises heat which accidentally leaks into any part of refrigeration system 10 or heat which is unintentionally or unknowingly absorbed into any part of refrigeration system 10, either due to poor insulation or other reasons, is not an active heat source.

In one preferred embodiment of the invention, temperature sensor 32 monitors the heat transfer fluid exiting evaporator 16 in order to insure that a portion of the heat transfer fluid is in a liquid state 29 upon exiting evaporator 16, as illustrated in FIG. 8. In one preferred embodiment of the invention, at least about 5% of the of the heat transfer fluid is vaporized before the heat transfer fluid enters the evaporator, and at least about 1% of the heat transfer fluid is in a liquid state upon exiting the evaporator. By insuring that a portion of the heat transfer fluid is in liquid state 29 and vapor state 31 upon entering and exiting the evaporator, the vapor compression system of the present invention allows evaporator 16 to operate with maximum efficiency. In one preferred embodiment of the invention, the heat transfer fluid is in at least about a 1% superheated state upon exiting evaporator 16. In one preferred embodiment of the invention, the heat transfer fluid is between about a 1% liquid state and about a 1% superheated vapor state upon exiting evaporator 16.

While the above embodiments rely on heat source 25 or the dimensions and length of saturated vapor line 28 to insure that the heat transfer fluid enters the evaporator 16 as a saturated vapor, any means known to one of ordinary skill in the art which can convert the heat transfer fluid to a saturated vapor upon entering evaporator 16 can be used. Additionally, while the above embodiments use temperature sensor 32 to monitor the state of the heat transfer fluid exiting the evaporator, any metering device known to one of ordinary skill in the art which can determine the state of the heat transfer fluid upon exiting the evaporator can be used, such as a pressure sensor, or a sensor which measures the density of the fluid. Additionally, while in the above embodiments, the metering device monitors the state of the heat transfer fluid exiting evaporator 16, the metering device can also be placed at any point in or around evaporator 16 to monitor the state of the heat transfer fluid at any point in or around evaporator 16.

Figure 2:
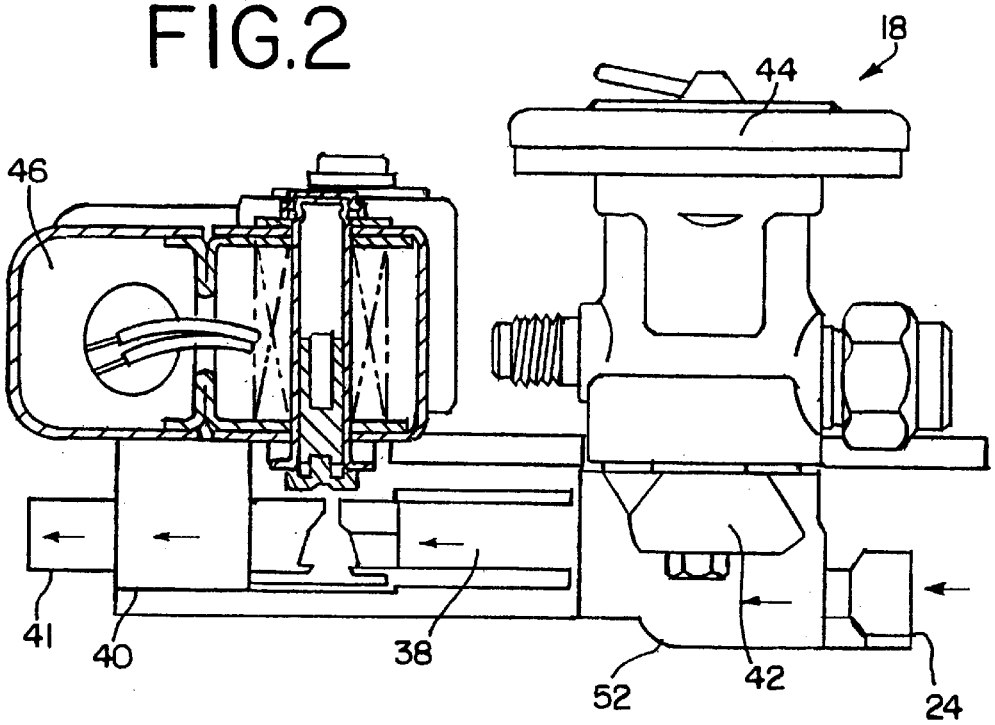
FIG. 2 is a side view, in partial cross-section, of a first side of a multifunctional valve in accordance with one embodiment of the invention.

Shown in FIG. 2 is a side view, in partial cross-section, of one embodiment of multifunctional valve 18. Heat transfer fluid enters first inlet 24 and traverses a first passageway 38 to a common chamber 40. An expansion valve 42 is positioned in first passageway 38 near first inlet 22. Expansion valve 42 meters the flow of the heat transfer fluid through first passageway 38 by means of a diaphragm (not shown) enclosed within an upper valve housing 44. Expansion valve 42 can be any device known to one of ordinary skill in the art that can be used to meter the flow of heat transfer fluid, such as a thermostatic expansion valve, a capillary tube, or a pressure control. Control line 33 is connected to an input 62 located on upper valve housing 44. Signals relayed through control line 33 activate the diaphragm within upper valve housing 44. The diaphragm actuates a valve assembly 54 (shown in FIG. 4) to control the amount of heat transfer fluid entering an expansion chamber 52 (shown in FIG. 4) from first inlet 24. A gating valve 46 is positioned in first passageway 38 near common chamber 40. In a preferred embodiment of the invention, gating valve 46 is a solenoid valve capable of terminating the flow of heat transfer fluid through first passageway 38 in response to an electrical signal.

Figure 3:
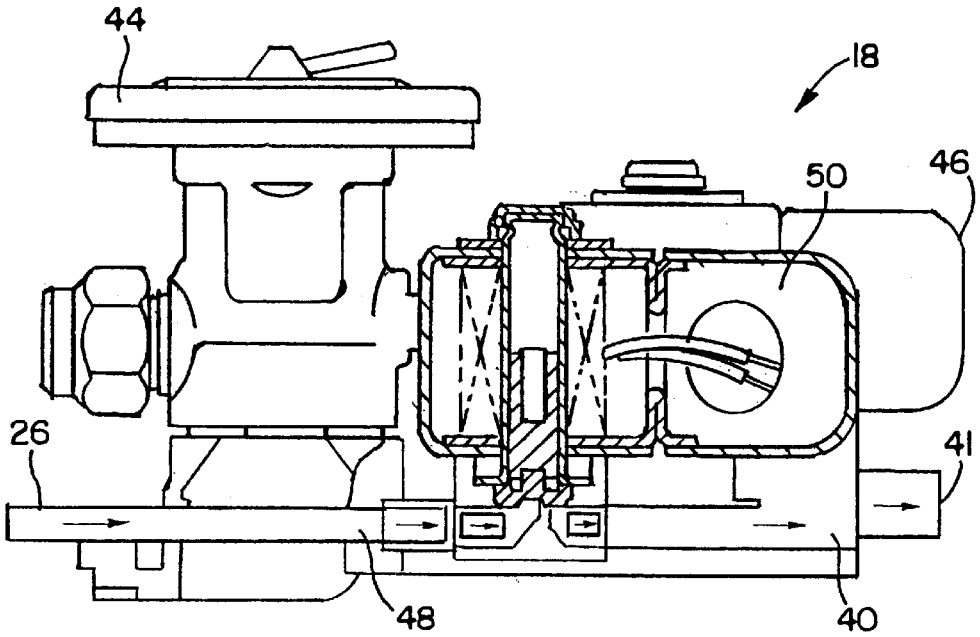
FIG. 3 is a side view, in partial cross-section, of a second side of the multifunctional valve illustrated in FIG. 2.

Shown in FIG. 3 is a side view, in partial cross-section, of a second side of multifunctional valve 18. A second passageway 48 couples second inlet 26 to common chamber 40. A gating valve 50 is positioned in second passageway 48 near common chamber 40. In a preferred embodiment of the invention, gating valve 50 is a solenoid valve capable of terminating the flow of heat transfer fluid through second passageway 48 upon receiving an electrical signal. Common chamber 40 discharges the heat transfer fluid from multifunctional valve 18 through an outlet 41.

Figure 4:
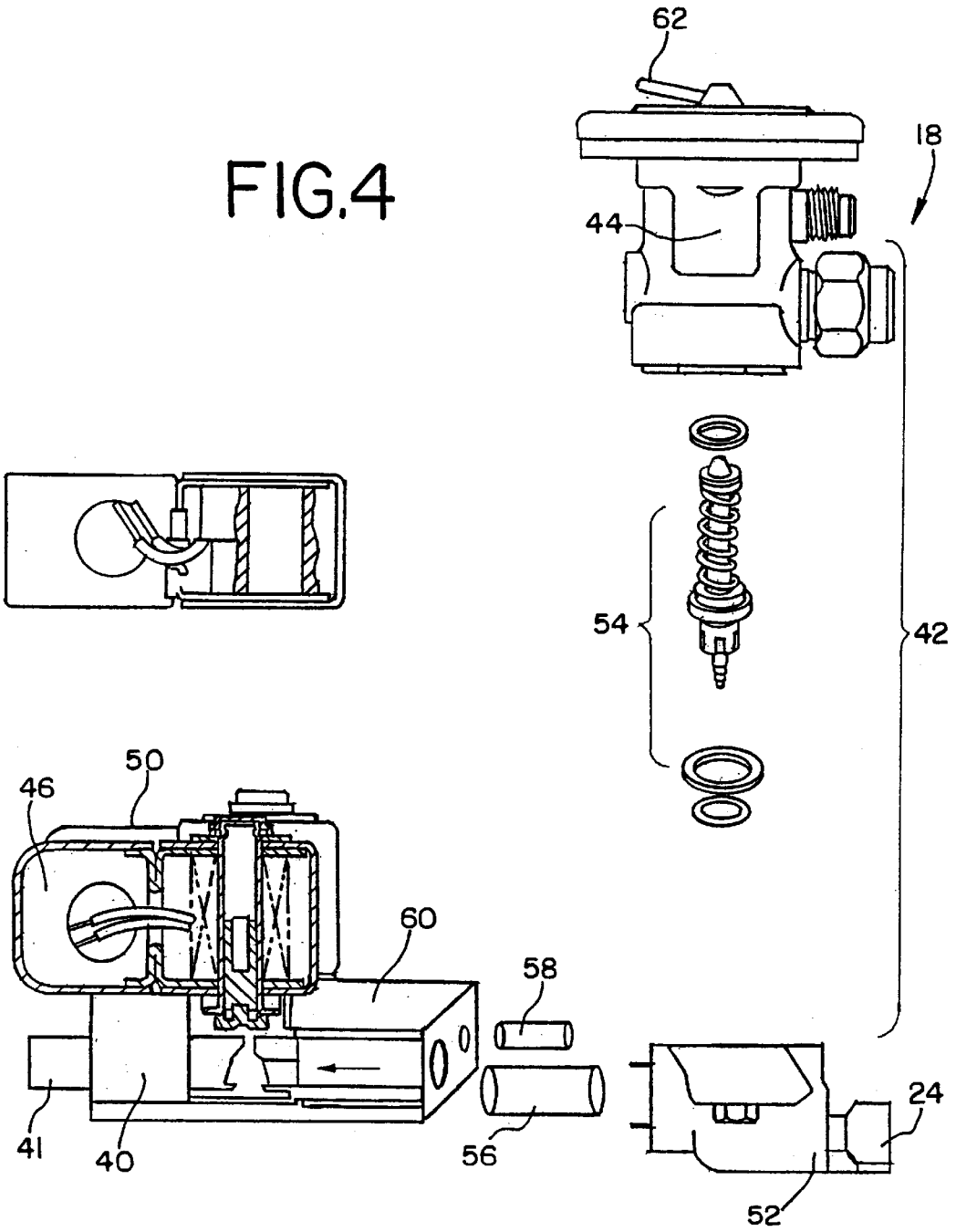
FIG. 4 is an exploded view of a multifunctional valve in accordance with one embodiment of the invention.

An exploded perspective view of multifunctional valve 18 is illustrated in FIG. 4. Expansion valve 42 is seen to include expansion chamber 52 adjacent first inlet 22, valve assembly 54, and upper valve housing 44. Valve assembly 54 is actuated by a diaphragm (not shown) contained within the upper valve housing 44. First and second tubes 56 and 58 are located intermediate to expansion chamber 52 and a valve body 60. Gating valves 46 and 50 are mounted on valve body 60. In accordance with the invention, refrigeration system 10 can be operated in a defrost mode by closing gating valve 46 and opening gating valve 50. In defrost mode, high temperature heat transfer fluid enters second inlet 26 and traverses second passageway 48 and enters common chamber 40. The high temperature vapors are discharged through outlet 41 and traverse saturated vapor line 28 to evaporator 16. The high temperature vapor has a temperature sufficient to raise the temperature of evaporator 16 by about 50 to 120° F. (27.8 to 66.7° C.). The temperature rise is sufficient to remove frost from evaporator 16 and restore the heat transfer rate to desired operational levels.

While the above embodiments use a multifunctional valve 18 for expanding the heat transfer fluid before entering evaporator 16, any thermostatic expansion valve or throttling valve, such as expansion valve 42 or even recovery valve 19, may be used to expand heat transfer fluid before entering evaporator 16.

Figure 9:
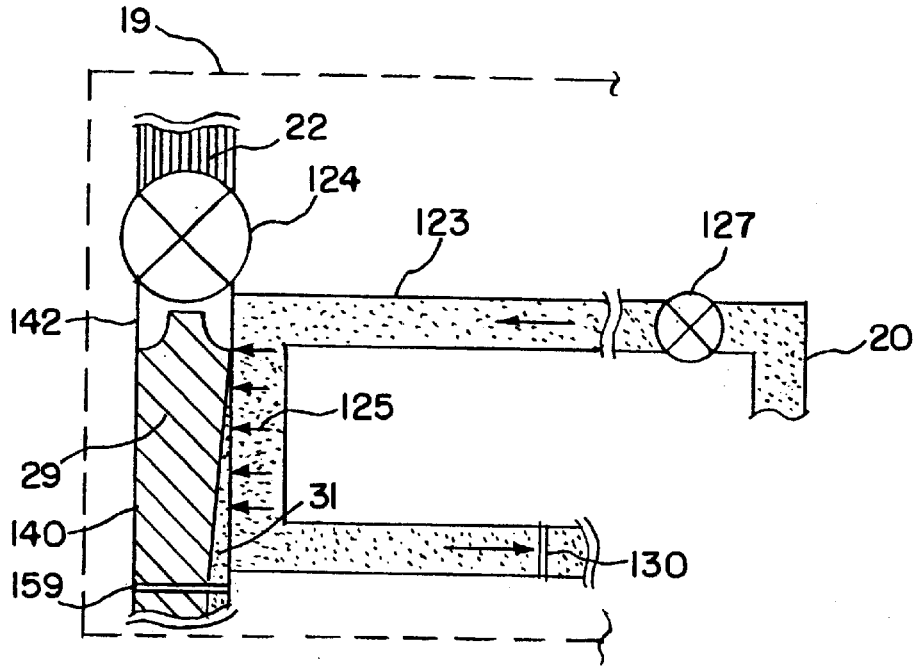
FIG. 9 is a schematic view, in partial cross-section, of a recovery valve in accordance with one embodiment of this invention.
Figure 10:
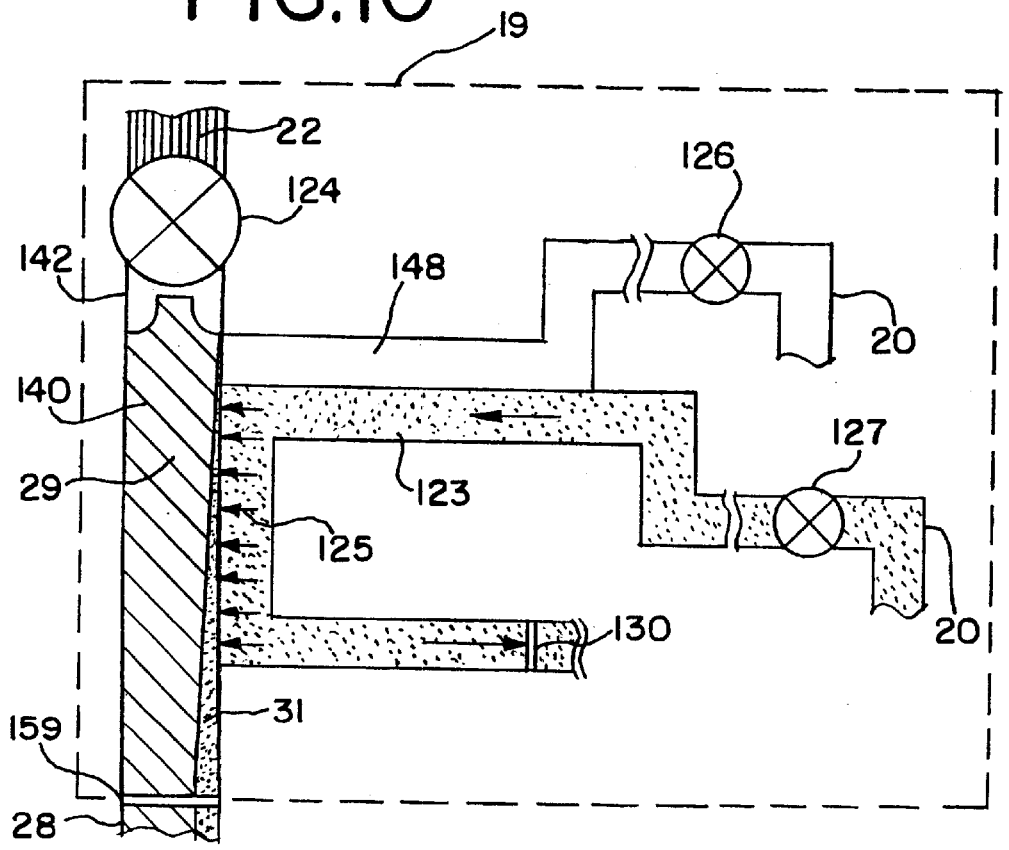
FIG. 10 is a schematic view, in partial cross-section, of a recovery valve in accordance with yet another embodiment of this invention.
Figure 12:
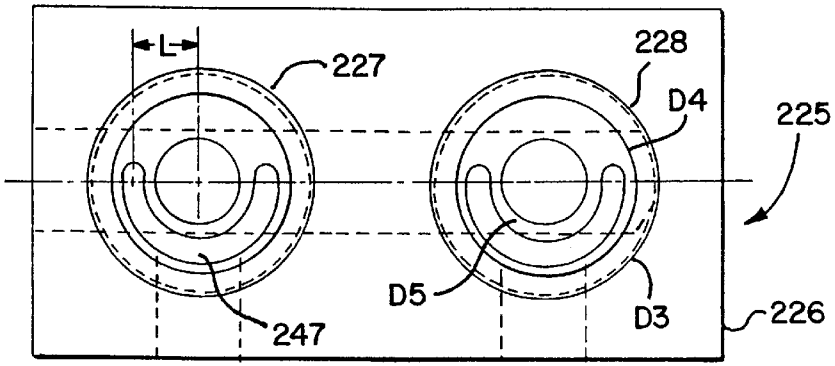
FIG. 12 is a side elevational view of the valve body of the multifunctional valve shown in FIG. 11.

In one preferred embodiment of the invention heat source 25 is applied to the heat transfer fluid after the heat transfer fluid passes through expansion valve 42 and before the heat transfer fluid enters the inlet of evaporator 16 to convert the heat transfer fluid from a low quality liquid vapor mixture to a high quality liquid vapor mixture, or a saturated vapor. In one preferred embodiment of the invention, heat source 25 is applied to a multifunctional valve 18. In another preferred embodiment of the invention heat source 25 is applied within recovery valve 19, as illustrated in FIG. 9. Recovery valve 19 comprises a first inlet 124 connected to liquid line 22 and a first outlet 159 connected to saturated vapor line 28. Heat transfer fluid enters first inlet 124 of recovery valve 19 to a common chamber 140. An expansion valve 142 is positioned near first inlet 124 to expand the heat transfer fluid entering first inlet 124 from a liquid state to a low quality liquid vapor mixture. Second inlet 127 is connected to discharge line 20, and receives high temperature heat transfer fluid exiting compressor 12. High temperature heat transfer fluid exiting compressor 12 enters second inlet 127 and traverses second passageway 123. Second passageway 123 is connected to second inlet 127 and second outlet 130. A portion of second passageway 123 is located adjacent to common chamber 140.

As the high temperature heat transfer fluid nears common chamber 140, heat from the high temperature heat transfer fluid is transferred from the second passageway 123 to the common chamber 140 in the form of heat source 125. By applying heat from heat source 125 to the heat transfer fluid, the heat transfer fluid in common chamber 140 is converted from a low quality liquid vapor mixture to a high quality liquid vapor mixture, or saturated vapor, as the heat transfer fluid flows through common chamber 140. Additionally, the high temperature heat transfer fluid in the second passageway 123 is cooled as the high temperature heat transfer fluid passes near common chamber 140. Upon traversing second passageway 123, the cooled high temperature heat transfer fluid exits second outlet 130 and enters condensor 14. Heat transfer fluid in common chamber 140 exits recover valve 19 at first outlet 159 into saturated vapor line 28 as a high quality liquid vapor mixture, or saturated vapor.

While in the above preferred embodiment, heat source 125 comprises heat transferred to the ambient surroundings from a compressor, heat source 125 may comprise any external or internal source of heat known to one of ordinary skill in the art, such as, for example, heat generated from an electrical heat source, heat generated using combustible materials, heat generated using solar energy, or any other source of heat. Heat source 125 can also comprise any heat source 25 and any active heat source, as previously defined.

In one preferred embodiment of the invention, recovery valve 19 comprises third passageway 148 and third inlet 126. Third inlet 126 is connected to discharge line 20, and receives high temperature heat transfer fluid exiting compressor 12. A first gating valve (not shown) capable of terminating the flow of heat transfer fluid through common chamber 140 is positioned near the first inlet 124 of common chamber 140. Third passageway 148 connects third inlet 126 to common chamber 140. A second gating valve (not shown) is positioned in third passageway 148 near common chamber 140. In a preferred embodiment of the invention, the second gating valve is a solenoid valve capable of terminating the flow of heat transfer fluid through third passageway 148 upon receiving an electrical signal.

In accordance with the invention, refrigeration system 10 can be operated in a defrost mode by closing the first gating valve located near first inlet 124 of common chamber 140 and opening the second gating valve positioned in third passageway 148 near common chamber 140. In defrost mode, high temperature heat transfer fluid from compressor 12 enters third inlet 126 and traverses third passageway 148 and enters common chamber 140. The high temperature heat transfer fluid is discharged through first outlet 159 of recovery valve 19 and traverses saturated vapor line 28 to evaporator 16. The high temperature heat transfer fluid has a temperature sufficient to raise the temperature of evaporator 16 by about 50 to 120° F. (27.8 to 66.7° C.). The temperature rise is sufficient to remove frost from evaporator 16 and restore the heat transfer rate to desired operational levels.

During the defrost cycle, any pockets of oil trapped in the system will be warmed and carried in the same direction of flow as the heat transfer fluid. By forcing hot gas through the system in a forward flow direction, the trapped oil will eventually be returned to the compressor. The hot gas will travel through the system at a relatively high velocity, giving the gas less time to cool thereby improving the defrosting efficiency. The forward flow defrost method of the invention offers numerous advantages to a reverse flow defrost method. For example, reverse flow defrost systems employ a small diameter check valve near the inlet of the evaporator. The check valve restricts the flow of hot gas in the reverse direction reducing its velocity and hence its defrosting efficiency. Furthermore, the forward flow defrost method of the invention avoids pressure build up in the system during the defrost system. Additionally, reverse flow methods tend to push oil trapped in the system back into the expansion valve. This is not desirable because excess oil in the expansion can cause gumming that restricts the operation of the valve. Also, with forward defrost, the liquid line pressure is not reduced in any additional refrigeration circuits being operated in addition to the defrost circuit.

It will be apparent to those skilled in the art that a vapor compression system arranged in accordance with the invention can be operated with less heat transfer fluid those comparable sized system of the prior art. By locating the multifunctional valve near the condenser, rather than near the evaporation, the saturated vapor line is filled with a relatively low-density vapor, rather than a relatively high-density liquid. Alternatively, by applying a heat source to the saturated vapor line, the saturated vapor line is also filled with a relatively low-density vapor, rather than a relatively high-density liquid. Additionally, prior art systems compensate for low temperature ambient operations (e.g. winter time) by flooding the evaporator in order to reinforce a proper head pressure at the expansion valve. In one preferred embodiment of the invention, vapor compression system heat pressure is more readily maintained in cold weather, since the multifunctional value is positioned in close proximity to the condenser.

The forward flow defrost capability of the invention also offers numerous operating benefits as a result of improved defrosting efficiency. For example, by forcing trapped oil back into the compressor, liquid slugging is avoided, which has the effect of increasing the useful life of the equipment. Furthermore, reduced operating cost are realized because less time is required to defrost the system. Since the flow of hot gas can be quickly terminated, the system can be rapidly returned to normal cooling operation. When frost is removed from evaporator 16, temperature sensor 32 detects a temperature increase in the heat transfer fluid in suction line 30. When the temperature rises to a given set point, gating valve 50 and multifunctional valve 18 is closed. Once the flow of heat transfer fluid through first passageway 38 resumes, cold saturated vapor quickly returns to evaporator 16 to resume refrigeration operation.

Those skilled in the art will appreciate that numerous modifications can be made to enable the refrigeration system of the invention to address a variety of applications. For example, refrigeration systems operating in retail food outlets typically include a number of refrigeration cases that can be serviced by a common compressor system. Also, in applications requiring refrigeration operations with high thermal loads, multiple compressors can be used to increase the cooling capacity of the refrigeration system.

Figure 5:
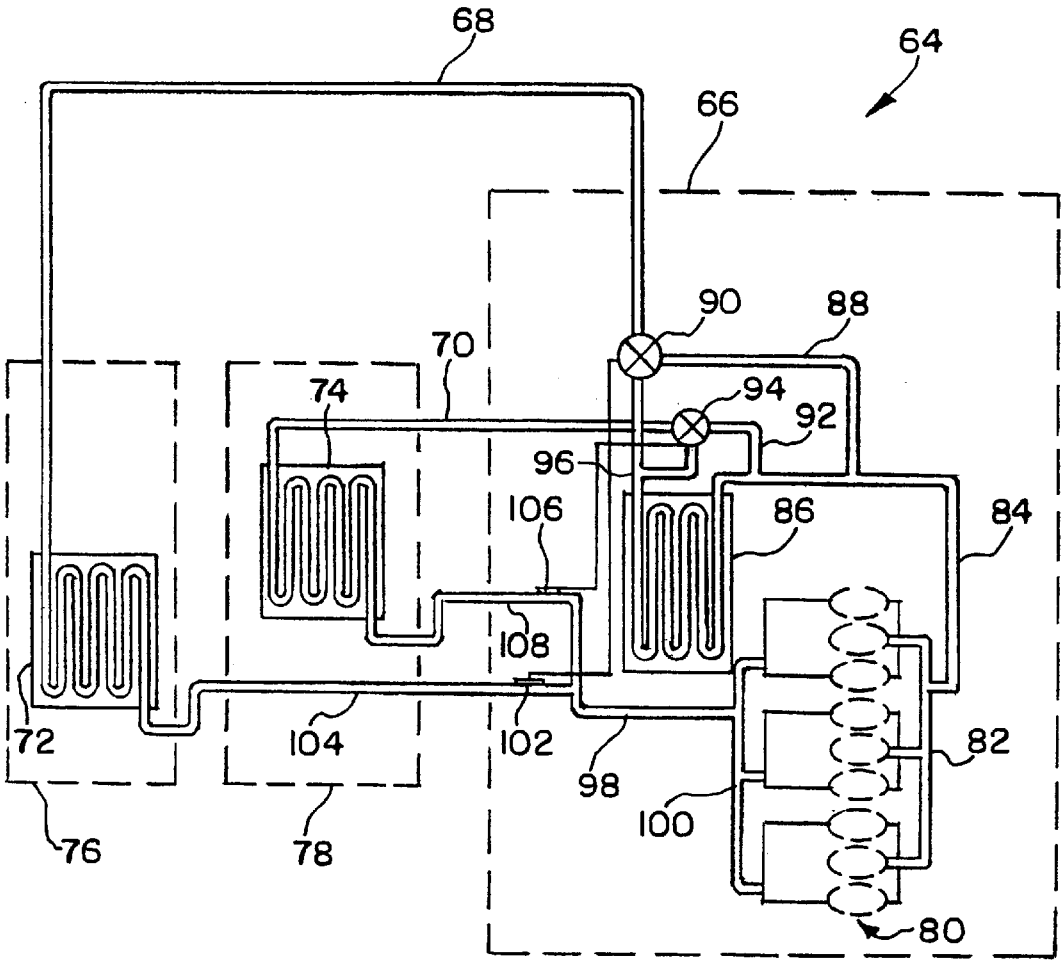
FIG. 5 is a schematic view of a vapor-compression system in accordance with another embodiment of the invention.

A vapor compression system 64 in accordance with another embodiment of the invention having multiple evaporators and multiple compressors is illustrated in FIG. 5. In keeping with the operating efficiency and low-cost advantages of the invention, the multiple compressors, the condenser, and the multiple multifunctional valves are contained within a control unit 66. Saturated vapor lines 68 and 70 feed saturated vapor from control unit 66 to evaporators 72 and 74, respectively. Evaporator 72 is located in a first refrigeration case 76, and evaporator 74 is located in a second refrigeration case 78. First and second refrigeration cases 76 and 78 can be located adjacent to each other, or alternatively, at relatively great distance from each other. The exact location will depend upon the particular application. For example, in a retail food outlet, refrigeration cases are typically placed adjacent to each other along an isle way. Importantly, the refrigeration system of the invention is adaptable to a wide variety of operating environments. This advantage is obtained, in part, because the number of components within each refrigeration case is minimal. In one preferred embodiment of the invention, by avoiding the requirement of placing numerous system components in proximity to the evaporator, the refrigeration system can be used where space is at a minimum. This is especially advantageous to retail store operations, where floor space is often limited.

In operation, multiple compressors 80 feed heat transfer fluid into an output manifold 82 that is connected to a discharge line 84. Discharge line 84 feeds a condenser 86 and has a first branch line 88 feeding a first multifunctional valve 90 and a second branch line 92 feeding a second multifunctional valve 94. A bifurcated liquid line 96 feeds heat transfer fluid from condenser 86 to first and second multifunctional valves 90 and 94. Saturated vapor line 68 couples first multifunctional valve 90 with evaporator 72, and saturated vapor line 70 couples second multifunctional valve 94 with evaporator 74. A bifurcated suction line 98 couples evaporators 72 and 74 to a collector manifold 100 feeding multiple compressors 80. A temperature sensor 102 is located on a first segment 104 of bifurcated suction line 98 and relays signals to first multifunctional valve 90. A temperature sensor 106 is located on a second segment 108 of bifurcated suction line 98 and relays signals to second multifunctional valve 94. In one preferred embodiment of the invention, a heat source, such as heat source 25, can be applied to saturated vapor lines 68 and 70 to insure that the heat transfer fluid enters evaporators 72 and 74 as a saturated vapor.

Those skilled in the art will appreciate that numerous modifications and variations of vapor compression system 64 can be made to address different refrigeration applications. For example, more than two evaporators can be added to the system in accordance with the general method illustrated in FIG. 5. Additionally, more condensers and more compressors can also be included in the refrigeration system to further increase the cooling capability.

Figure 6:
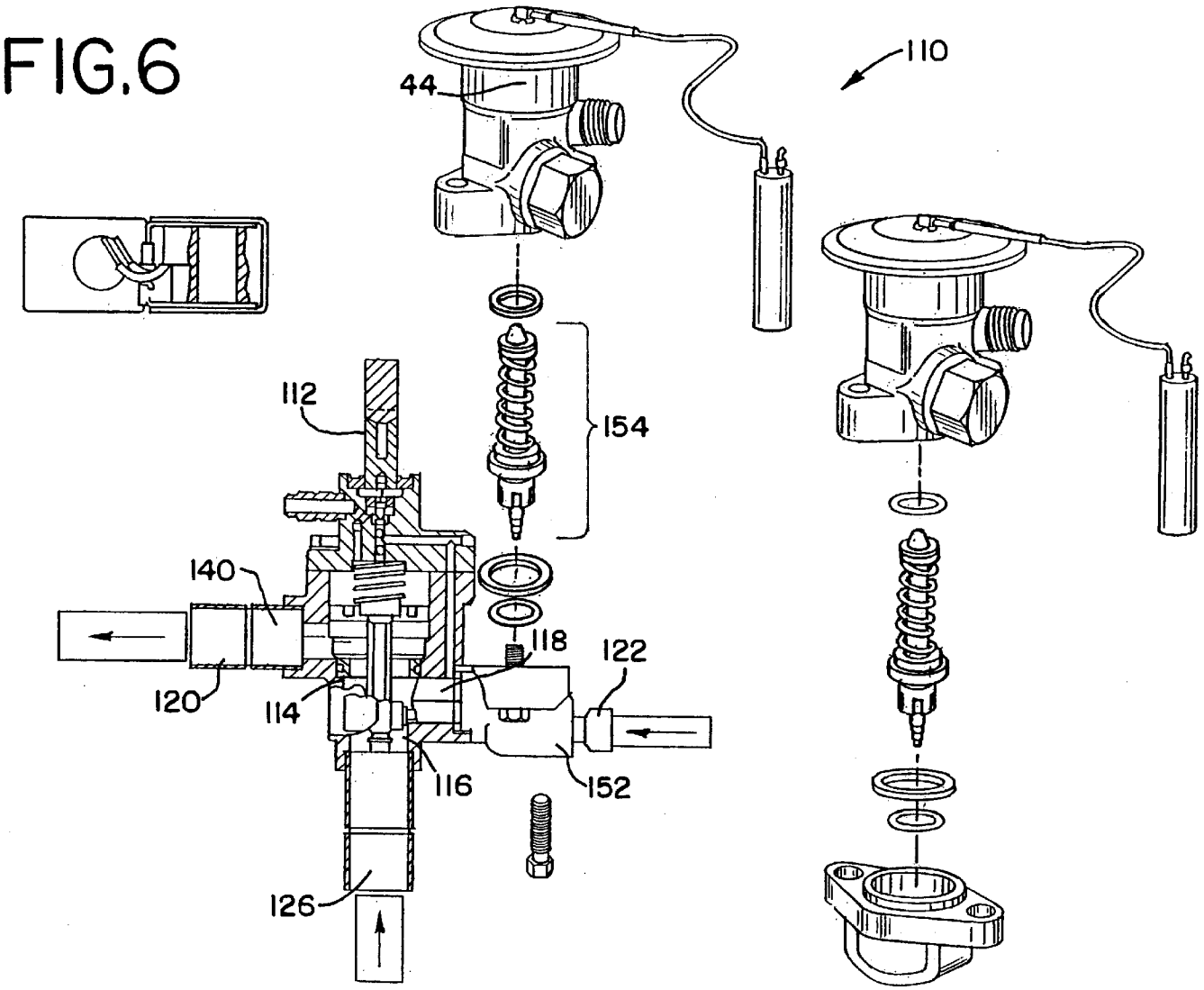
FIG. 6 is an exploded view of the multifunctional valve in accordance with another embodiment of the invention.

A multifunctional valve 110 arranged in accordance with another embodiment of the invention is illustrated in FIG. 6. In similarity with the previous multifunctional valve embodiment, the heat transfer fluid exiting the condenser in the liquid state enters a first inlet 122 and expands in expansion chamber 152. The flow of heat transfer fluid is metered by valve assembly 154. In the present embodiment, a solenoid valve 112 has an armature 114 extending into a common seating area 116. In refrigeration mode, armature 114 extends to the bottom of common seating area 116 and cold refrigerant flows through a passageway 118 to a common chamber 140, then to an outlet 120. In defrost mode, hot vapor enters second inlet 126 and travels through common seating area 116 to common chamber 140, then to outlet 120. Multifunctional valve 110 includes a reduced number of components, because the design is such as to allow a single gating valve to control the flow of hot vapor and cold vapor through the valve.

In yet another embodiment of the invention, the flow of liquefied heat transfer fluid from the liquid line through the multifunctional valve can be controlled by a check valve positioned in the first passageway to gate the flow of the liquefied heat transfer fluid into the saturated vapor line. The flow of heat transfer fluid through the refrigeration system is controlled by a pressure valve located in the suction line in proximity to the inlet of the compressor. Accordingly, the various functions of a multifunctional valve of the invention can be performed by separate components positioned at different locations within the refrigeration system. All such variations and modifications are contemplated by the present invention.

Those skilled in the art will recognize that the vapor compression system and method described herein can be implemented in a variety of configurations. For example, the compressor, condenser, multifunctional valve, and the evaporator can all be housed in a single unit and placed in a walk-in cooler. In this application, the condenser protrudes through the wall of the walk-in cooler and ambient air outside the cooler is used to condense the heat transfer fluid.

In another application, the vapor compression system and method of the invention can be configured for air-conditioning a home or business. In this application, a defrost cycle is unnecessary since icing of the evaporator is usually not a problem.

In yet another application, the vapor compression system and method of the invention can be used to chill water. In this application, the evaporator is immersed in water to be chilled. Alternatively, water can be pumped through tubes that are meshed with the evaporator coils.

In a further application, the vapor compression system and method of the invention can be cascaded together with another system for achieving extremely low refrigeration temperatures. For example, two systems using different heat transfer fluids can be coupled together such that the evaporator of a first system provide a low temperature ambient. A condenser of the second system is placed in the low temperature ambient and is used to condense the heat transfer fluid in the second system.

Another embodiment of a multifunctional valve or device 225 is shown in FIGS. 11–14 and is generally designated by the reference numeral 225. This embodiment is functionally similar to that described in FIGS. 2–4 and FIG. 6 which was generally designated by the reference numeral 18. As shown, this embodiment includes a main body or housing 226 which preferably is constructed as a single one-piece structure having a pair of threaded bosses 227, 228 that receive a pair of gating valves and collar assemblies, one of which being shown in FIG. 13 and designated by the reference numeral 229. This assembly includes a threaded collar 230, gasket 231 and solenoid-actuated gating valve receiving member 232 having a central bore 233, that receives a reciprocally movable valve pin 234 that includes a spring 235 and needle valve element 236 which is received with a bore 237 of a valve seat member 238 having a resilient seal 239 that is sized to be sealingly received in well 240 of the housing 226. A valve seat member 241 is snuggly received in a recess 242 of valve seat member 238. Valve seat member 241 includes a bore 243 that cooperates with needle valve element 236 to regulate the flow of refrigerant therethrough.

Figure 16:
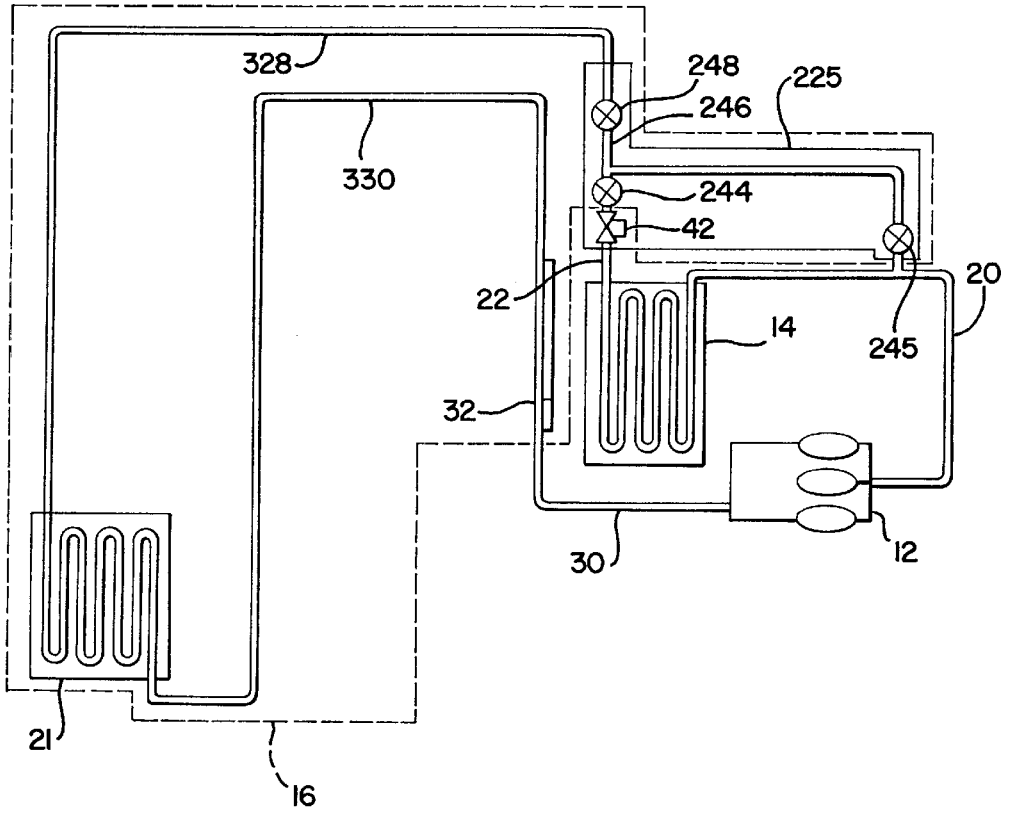
FIG. 16 is a schematic drawing of a vapor-compression system arranged in accordance with another embodiment of the invention.

A first inlet 244 (corresponding to first inlet 24 in the previously described embodiment) receives liquid feed refrigerant from expansion valve 42, and a second inlet 245 (corresponding to second inlet 26 of the previously described embodiment) receives hot gas from the compressor 12 during a defrost cycle. In one preferred embodiment multifunctional valve 225 comprises first inlet 244, outlet 248, common chamber 246, and expansion valve 42, as illustrated in FIG. 16. In one preferred embodiment, expansion valve 42 is connected with first inlet 244. The valve body 226 includes a common chamber 246 (corresponding to common chamber 40 in the previously described embodiment). Expansion valve 42 receives refrigerant from the condenser 14 which then passes through inlet 244 into a semicircular well 247 which, when gating valve 229 is open, then passes into common chamber 246 and exits from the multifunctional valve 225 through outlet 248 (corresponding to outlet 41 in the previously described embodiment).

Figure 11:
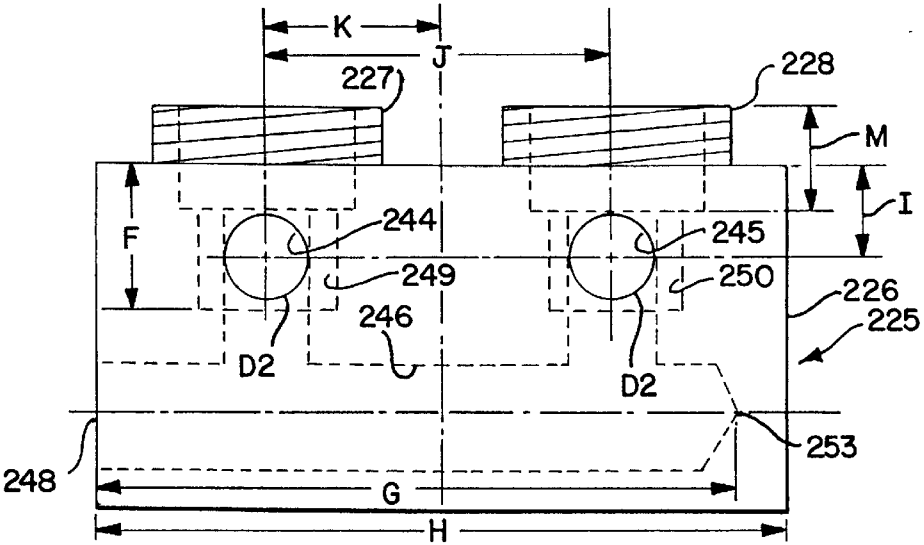
FIG. 11 is a plan view, partially in section, of valve body on a multifunctional valve or device in accordance with a further embodiment of the present invention.
Figure 13:
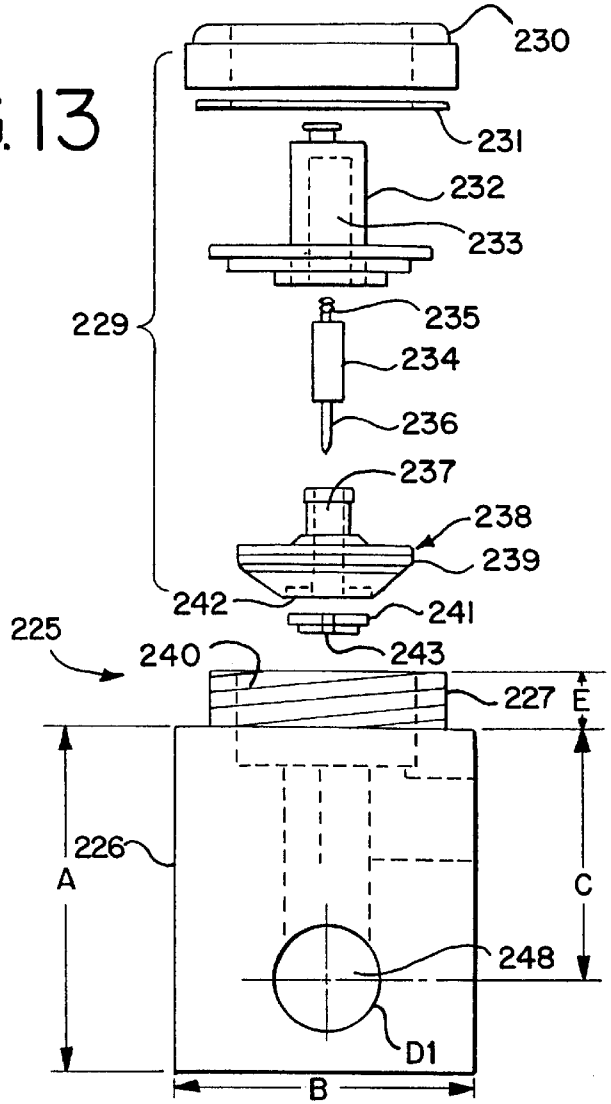
FIG. 13 is an exploded view, partially in section, of the multifunctional valve or device shown in FIGS. 11 and 12.
Figure 14:
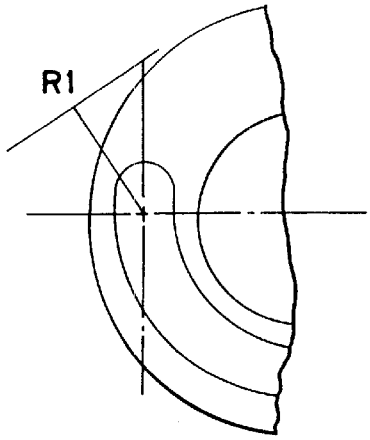
FIG. 14 is an enlarged view of a portion of the multifunctional valve or device shown in FIG. 12.

A best shown in FIG. 11 the valve body 226 includes a first passageway 249 (corresponding to first passageway 38 of the previously described embodiment) which communicates first inlet 244 with common chamber 246. In like fashion, a second passageway 250 (corresponding to second passageway 48 of the previously described embodiment) communicates second inlet 245 with common chamber 246.

Insofar as operation of the multifunctional valve or device 225 is concerned, reference is made to the previously described embodiment since the components thereof function in the same way during the refrigeration and defrost cycles. In one preferred embodiment, the heat transfer fluid exits the condenser 14 in the liquid state passes through expansion valve 42. As the heat transfer fluid passes through expansion valve 42, the heat transfer fluid changes from a liquid to a liquid vapor mixture. The heat transfer fluid enter the first inlet 244 as a liquid vapor mixture and expands in common chamber 246. In one preferred embodiment, the heat transfer fluid expands in a direction away from the flow of the heat transfer fluid. As the heat transfer fluid expands in common chamber 246, the liquid separates from the vapor in the heat transfer fluid. The heat transfer fluid then exits common chamber 246. Preferably, the heat transfer fluid exits common chamber 246 as a liquid and a vapor, wherein a substantial amount of the liquid is separate and apart from a substantial amount of the vapor. The heat transfer fluid then passes through outlet 248 and travels through saturated vapor line 28 to evaporator 16. In one preferred embodiment, the heat transfer fluid then passes through outlet 248 and enters evaporator 16 at first evaporative line 328, as described in more detail below. Preferably, the heat transfer fluid travels from outlet 248 to the inlet of evaporator 16 as a liquid and a vapor, wherein a substantial amount of the liquid is separate and apart from a substantial amount of the vapor.

In one preferred embodiment, a pair of gating valves 229 can be used to control the flow of heat transfer fluid or hot vapor into common chamber 246. In refrigeration mode, a first gating valve 229 is opened to allow refrigerant to flow through first inlet 244 and into common chamber 246, and then to outlet 248. In defrost mode, a second gating valve 229 is opened to allow hot vapor to flow through second inlet 245 and into common chamber 246, and then to outlet 248. While in the above embodiments, multifunctional valve 225 has been described as having multiple gating valves 229, multifunctional valve 225 can be designed with only one gating valve. Additionally, multifunctional valve 225 has been described as having a second inlet 245 for allowing hot vapor to flow through during defrost mode, multifunctional valve 225 can be designed with only first inlet 244.

Figure 15:
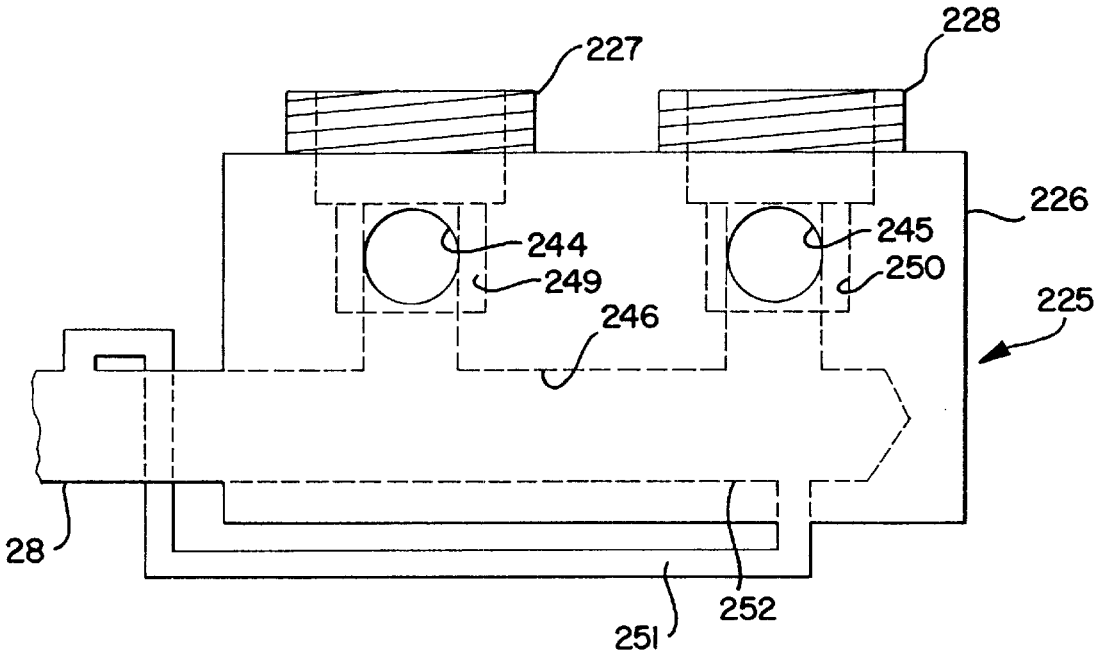
FIG. 15 is a plan view, partially in section, of valve body on a multifunctional valve or device in accordance with a further embodiment of the present invention.

In one preferred embodiment, multifunctional valve comprises bleed line 251, as illustrated in FIG. 15. Bleed line 251 is connected with common chamber 246 and allows heat transfer fluid that is in common chamber 246 to travel to saturated vapor line 28 or first evaporative line 328. In one preferred embodiment, bleed line 251 allows the liquid that has separated from the liquid vapor mixture entering common chamber 246 to travel to saturated vapor line 28 or first evaporative line 328. Preferably, bleed line 251 is connected to bottom surface 252 of common chamber 246, wherein bottom surface 252 is the surface of common chamber 246 located nearest the ground.

In one preferred embodiment, multifunctional valve 225 is dimensioned as specified below in Table A and as illustrated in FIGS. 11–14. The length of common chamber 246 will be defined as the distance from outlet 248 to back wall 253. The length of common chamber 246 is represented by the letter G, as illustrated in FIG. 11. Common chamber 246 has a first portion adjacent to a second portion, wherein the first portion begins at outlet 248 and the second portion ends at back wall 253, as illustrated in FIG. 1. First inlet 244 and outlet 248 are both connected with the first portion. The heat transfer fluid enters common chamber 246 through first inlet 244 and within the first portion of the common chamber 246. In one preferred embodiment, the first portion has a length equal to no more than about 75% of the length of common chamber 246. More preferably, the first portion has a length equal to no more than about 35% of the length of common chamber 246.

TABLE A

DIMENSIONS OF MULTIFUNCTIONAL VALVE

| Dimensions | Inches (all dimensions not specified are to be +/−0.015) | Millimeters (all dimensions not specified are to be +/−0.381) |
|---|---|---|
| A | 2.500 | 63.5 |
| B | 2.125 | 53.975 |
| C | 1.718 | 43.637 |
| D1 (diameter) | 0.812 | 20.625 |
| D2 (diameter) | 0.609 | 15.469 |
| D3 (diameter) | 1.688 | 42.875 |
| D4 (diameter) | 1.312 (+/−0.002) | 33.325 (+/−0.051) |
| D5 (diameter) | 0.531 | 13.487 |

TABLE A-continued

DIMENSIONS OF MULTIFUNCTIONAL VALVE

| Dimensions | Inches (all dimensions not specified are to be +/−0.015) | Millimeters (all dimensions not specified are to be +/−0.381) |
|---|---|---|
| E | 0.406 | 10.312 |
| F | 1.062 | 26.975 |
| G | 4.500 | 114.3 |
| H | 5.000 | 127 |
| I | 0.781 | 19.837 |
| J | 2.500 | 63.5 |
| K | 1.250 | 31.75 |
| L | 0.466 | 11.836 |
| M | 0.812 (+/−0.005) | 20.6248 (+/−0.127) |
| R1 (radius) | 0.125 | 3.175 |

In one preferred embodiment, the heat transfer fluid passes through expansion valve 42 and then enters the inlet of evaporator 16, as illustrated in FIG. 16. In this embodiment, evaporator 16 comprises first evaporative line 328, evaporator coil 21, and second evaporative line 330. First evaporative line 328 is positioned between outlet 248 and evaporator coil 21, as illustrated in FIG. 16. Second evaporative line 330 is positioned between evaporative coil 21 and temperature sensor 32. Evaporator coil 21 is any conventional coil or device that absorbs heat. Multifunctional valve 18 is preferably connected with and adjacent evaporator 16. In one preferred embodiment, evaporator 16 comprises a portion of multifunctional valve 18, such as first inlet 244, outlet 248, and common chamber 246, as illustrated in FIG. 16. Preferably, expansion valve 42 is positioned adjacent evaporator 16. Heat transfer fluid exits expansion valve 42 and then directly enters evaporator 16 at inlet 244. As the heat transfer fluid exits expansion valve 42 and enters evaporator 16 at inlet 244, the temperature of the heat transfer fluid is at an evaporative temperature, that is the heat transfer fluid begins to absorb heat upon passing through expansion valve 42.

Upon passing through inlet 244, common chamber 246, and outlet 248, the heat transfer fluid enters first evaporative line 328. Preferably, first evaporative line 328 is insulated. Heat transfer fluid then exits first evaporative line 328 and enters evaporative coil 21. Upon exiting evaporative coil 21, heat transfer fluid enters second evaporative line 330. Heat transfer fluid exists second evaporative line 330 and evaporator 16 at temperature sensor 32.

Preferably, every element within evaporator 16, such as saturated vapor line 28, multifunctional valve 18, and evaporator coil 21, absorbs heat. In one preferred embodiment, as the heat transfer fluid passes through expansion valve 42, the heat transfer fluid is at a temperature within 20° F. of the temperature of the heat transfer fluid within the evaporator coil 21. In another preferred embodiment, the temperature of the heat transfer fluid in any element within evaporator 16, such as saturated vapor line 28, multifunctional valve 18, and evaporator coil 21, is within 20° F. of the temperature of the heat transfer fluid in any other element within evaporator 16.

As known by one of ordinary skill in the art, every element of refrigeration system 10 described above, such as evaporator 16, liquid line 22, and suction line 30, can be scaled and sized to meet a variety of load requirements.

In one preferred embodiment, the refrigerant charge of the heat transfer fluid in refrigeration system 10, is equal to or greater than the refrigerant charge of a conventional system.

Without further elaboration it is believed that one skilled in the art can, using the preceding description, utilize the invention to its fullest extent. The following examples are merely illustrative of the invention and are not meant to limit the scope in any way whatsoever.

EXAMPLE I

A 5-ft (1.52 m) Tyler Chest Freezer was equipped with a multifunctional valve in a refrigeration circuit, and a standard expansion valve was plumbed into a bypass line so that the refrigeration circuit could be operated as a conventional refrigeration system and as an XDX refrigeration system arranged in accordance with the invention. The refrigeration circuit described above was equipped with a saturated vapor line having an outside tube diameter of about 0.375 inches (0.953 cm) and an effective tube length of about 10 ft (3.048 m). The refrigeration circuit was powered by a Copeland hermetic compressor having a capacity of about ⅓ ton (338 kg) of refrigeration. A sensing bulb was attached to the suction line about 18 inches from the compressor. The circuit was charged with about 28 oz. (792 g) of R-12 refrigerant available from The DuPont Company. The refrigeration circuit was also equipped with a bypass line extending from the compressor discharge line to the saturated vapor line for forward-flow defrosting (See FIG. 1). All refrigerated ambient air temperature measurements were made using a "CPS Date Logger" by CPS temperature sensor located in the center of the refrigeration case, about 4 inches (10 cm) above the floor.

XDX System—Medium Temperature Operation

The nominal operating temperature of the evaporator was 20° F. (−6.7° C.) and the nominal operating temperature of the condenser was 120° F. (48.9° C.). The evaporator handled a cooling load of about 3000 Btu/hr (21 g cal/s). The multifunctional valve metered refrigerant into the saturated vapor line at a temperature of about 20° F. (−6.7° C.). The sensing bulb was set to maintain about 25° F. (13.9° C.) superheating of the vapor flowing in the suction line. The compressor discharged pressurized refrigerant into the discharge line at a condensing temperature of about 120° F. (48.9° C.), and a pressure of about 172 lbs/in$^2$ (118,560 N/m$^2$).

XDX System—Low Temperature Operation

The nominal operating temperature of the evaporator was −5° F. (−20.5° C.) and the nominal operating temperature of the condenser was 115° F. (46.1° C.). The evaporator handled a cooling load of about 3000 Btu/hr (21 g cal/s). The multifunctional valve metered about 2975 ft/min (907 km/min) of refrigerant into the saturated vapor line at a temperature of about −5° F. (−20.5° C.). The sensing bulb was set to maintain about 20° F. (11.1° C.) superheating of the vapor flowing in the suction line. The compressor discharged about 2299 ft/min (701 m/min) of pressurized refrigerant into the discharge line at a condensing temperature of about 115° F. (46.1° C.), and a pressure of about 161 lbs/in$^2$ (110,977 N/m$^2$). The XDX system was operated substantially the same in low temperature operation as in medium temperature operation with the exception that the fans in the Tyler Chest Freezer were delayed for 4 minutes following defrost to remove heat from the evaporator coil and to allow water drainage from the coil.

The XDX refrigeration system was operated for a period of about 24 hours at medium temperature operation and about 18 hours at low temperature operation. The temperature of the ambient air within the Tyler Chest Freezer was measured about every minute during the 23 hour testing period. The air temperature was measured continuously during the testing period, while the refrigeration system was operated in both refrigeration mode and in defrost mode. During defrost cycles, the refrigeration circuit was operated in defrost mode until the sensing bulb temperature reached about 50° F. (10° C.). The temperature measurement statistics appear in Table I below.

Conventional System—Medium Temperature Operation With Electric Defrost

The Tyler Chest Freezer described above was equipped with a bypass line extending between the compressor discharge line and the suction line for defrosting. The bypass line was equipped with a solenoid valve to gate the flow of high temperature refrigerant in the line. An electric heat element was energized instead of the solenoid during this test. A standard expansion valve was installed immediately adjacent to the evaporator inlet and the temperature sensing bulb was attached to the suction line immediately adjacent to the evaporator outlet. The sensing bulb was set to maintain about 6° F. (3.33° C.) superheating of the vapor flowing in the suction line. Prior to operation, the system was charged with about 48 oz. (1.36 kg) of R-12 refrigerant.

The conventional refrigeration system was operated for a period of about 24 hours at medium temperature operation. The temperature of the ambient air within the Tyler Chest Freezer was measured about every minute during the 24 hour testing period. The air temperature was measured continuously during the testing period, while the refrigeration system was operated in both refrigeration mode and in reverse-flow defrost mode. During defrost cycles, the refrigeration circuit was operated in defrost mode until the sensing bulb temperature reached about 50° F. (10° C.). The temperature measurement statistics appear in Table I below.

Conventional System—Medium Temperature Operation With Air Defrost

The Tyler Chest Freezer described above was equipped with a receiver to provide proper liquid supply to the expansion valve and a liquid line dryer was installed to allow for additional refrigerant reserve. The expansion valve and the sensing bulb were positioned at the same locations as in the reverse-flow defrost system described above. The sensing bulb was set to maintain about 8° F. (4.4° C.) superheating of the vapor flowing in the suction line. Prior to operation, the system was charged with about 34 oz. (0.966 kg) of R-12 refrigerant.

The conventional refrigeration system was operated for a period of about 24½ hours at medium temperature operation. The temperature of the ambient air within the Tyler Chest Freezer was measured about every minute during the 24½ hour testing period. The air temperature was measured continuously during the testing period, while the refrigeration system was operated in both refrigeration mode and in air defrost mode. In accordance with conventional practice, four defrost cycles were programmed with each lasting for about 36 to 40 minutes. The temperature measurement statistics appear in Table I below.

TABLE I

| REFRIGERATION TEMPERATURES (° F./° C.) | | | | |
|---|---|---|---|---|
| | XDX[1] Medium Temperature | XDX[1] Low Temperature | Conventional[2] Electric Defrost | Conventional[2] Air Defrost |
| Average | 38.7/3.7 | 4.7/−15.2 | 39.7/4.3 | 39.6/4.2 |
| Standard Deviation | 0.8 | 0.8 | 4.1 | 4.5 |
| Variance | 0.7 | 0.6 | 16.9 | 20.4 |
| Range | 7.1 | 7.1 | 22.9 | 26.0 |

[1]one defrost cycle during 23 hour test period
[2]three defrost cycles during 24 hour test period As illustrated above, the XDX refrigeration system arranged in accordance with the invention maintains a desired the temperature within the chest freezer with less temperature variation than the conventional systems. The standard deviation, the variance, and the range of the temperature measurements taken during the testing period are substantially less than the conventional systems. This result holds for operation of the XDX system at both medium and low temperatures.

During defrost cycles, the temperature rise in the chest freezer was monitored to determine the maximum temperature within the freezer. This temperature should be as close to the operating refrigeration temperature as possible to avoid spoilage of food products stored in the freezer. The maximum defrost temperature for the XDX system and for the conventional systems is shown in Table II below.

TABLE II

| MAXIMUM DEFROST TEMPERATURE (° F./° C.) | | |
|---|---|---|
| XDX Medium Temperature | Conventional Electric Defrost | Conventional Air Defrost |
| 44.4/6.9 | 55.0/12.8 | 58.4/14.7 |

EXAMPLE II

The Tyler Chest Freezer was configured as described above and further equipped with electric defrosting circuits. The low temperature operating test was carried out as described above and the time needed for the refrigeration unit to return to refrigeration operating temperature was measured. A separate test was then carried out using the electric defrosting circuit to defrost the evaporator. The time needed for the XDX system and an electric defrost system to complete defrost and to return to the 5° F. (−15° C.) operating set point appears in Table III below.

TABLE III

| TIME NEEDED TO RETURN TO REFRIGERATION TEMPERATURE OF 5° F. (−15° C.) FOLLOWING | | |
|---|---|---|
| | XDX | Conventional System with Electric Defrost |
| Defrost Duration (min) | 10 | 36 |
| Recovery Time (min) | 24 | 144 |

As shown above, the XDX system using forward-flow defrost through the multifunctional valve needs less time to completely defrost the evaporator, and substantially less time to return to refrigeration temperature.

Thus, it is apparent that there has been provided, in accordance with the invention, a vapor compression system that fully provides the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. For example, non-halogenated refrigerants can be used, such as ammonia, and the like can also be used. It is therefore intended to include within the invention all such variations and modifications that fall within the scope of the appended claims and equivalents thereof.

What is claimed is:

1. An expansion valve, for a vapor compression system, comprising:

(a) an inlet for receiving a heat transfer fluid and (b) a common chamber comprising:

(i) a first portion in communication with the inlet comprising an outlet that provides egress for the heat transfer fluid to a saturated vapor line;

(ii) a second portion adjacent with the first portion comprising a back wall opposed to the outlet;

wherein the common chamber separates a substantial amount of a heat transfer fluid liquid from a substantial amount of a heat transfer fluid vapor prior to the heat transfer fluid exiting the first portion.

2. The expansion valve of claim 1, wherein the first portion of the common chamber has a length of no more than about 35% of the length of the common chamber.

3. The expansion valve of claim 1, further comprising a means for applying heat to said common chamber.

4. The expansion valve of claim 1, further comprising a bleed line connecting said common chamber with said saturated vapor line.

5. The expansion valve of claim 1, wherein said inlet is substantially perpendicular to said common chamber.

6. The expansion valve of claim 1, wherein said heat transfer fluid undergoes expansion in said common chamber.

7. A vapor compression system comprising;

a compressor for increasing the pressure and temperature of a heat transfer fluid;

a condenser for liquefying the heat transfer fluid;

a discharge line connecting the compressor to the condenser;

the expansion valve of claim 1;

a liquid line connecting the condenser to the inlet of the expansion valve;

an evaporator for transferring heat from ambient surroundings to the heat transfer fluid, wherein the evaporator is connected to said expansion valve; and a suction line connecting the evaporator to the compressor.

8. The vapor compression system of claim 7, wherein the evaporator further comprises at least one portion of the expansion valve and said portion is selected from the group consisting of the inlet, the outlet, and the common chamber.

9. The vapor compression system of claim 7, wherein the expansion valve is connected adjacent to the evaporator.

10. The vapor compression system of claim 7, wherein the expansion valve is connected adjacent to the condenser.

11. The vapor compression system of claim 7, wherein the expansion valve is connected closer to the evaporator than to the condenser.

12. The vapor compression system of claim 7, wherein the expansion valve is connected closer to the condenser than to the evaporator.

13. A method of generating a heat transfer fluid, for absorbing heat, comprising:

providing an expansion valve comprising an inlet providing fluid ingress for the heat transfer fluid to a common chamber, the common chamber comprising a first portion adjacent to a second portion, wherein the first portion comprises the inlet and an outlet and the second portion comprises a back wall opposed to the outlet;

providing a compressor to compress the heat transfer fluid to a relatively high temperature and pressure and flowing the heat transfer fluid through a first discharge line to a condenser and through a second discharge line to the expansion valve, wherein the outlet of said expansion valve provides fluid egress for the heat transfer fluid from the common chamber to a saturated vapor line and a substantial amount of heat transfer fluid liquid is separated from a substantial amount of heat transfer fluid vapor prior to exiting the common chamber and entering the saturated vapor line;

flowing the liquid and vapor portions of the heat transfer fluid through a saturated vapor line to an evaporator, wherein heat is transferred to the heat transfer fluid as more of the liquid portion of the heat transfer portion is converted to the vapor portion; and returning the heat transfer fluid to the compressor through a suction line.

14. The method of claim 13, wherein heat is added to the heat transfer fluid after said fluid exits the inlet port of the expansion valve and before the fluid enters the evaporator.

15. The method of claim 13, wherein the first portion of said expansion valve has a length of no more than about 35% of the length of the common chamber.

16. The method of claim 13, wherein said heat transfer fluid undergoes expansion in said common chamber.

17. The method of claim 13, wherein said heat transfer fluid leaves said evaporator as a mixture of liquid and vapor and is returned to said compressor through said suction line.

18. The method of claim 13, wherein said liquid portion the heat transfer fluid vaporizes to form a saturated vapor before the heat transfer fluid enters the evaporator.

19. A method of substantially separating a liquid component from a vapor component of a heat transfer fluid comprising:

compressing the heat transfer fluid in a compressor;

condensing the compressed heat transfer fluid in a condenser, wherein the condensed heat transfer fluid comprises a liquid and vapor mixture;

flowing the liquid and vapor mixture through an expansion valve comprising an inlet that provides fluid ingress to a common chamber that comprises an outlet and a back wall opposite the outlet, wherein the common chamber substantially separates the liquid and vapor components of the heat transfer fluid before the liquid and vapor mixture passes through said outlet to a saturated vapor line.

20. The method of claim 19, wherein the expansion valve comprises a first portion adjacent to a second portion and the first portion comprises the inlet and the outlet and the second portion comprises the back wall.

21. The method of claim 20, wherein the first portion of the common chamber has a length of no more than about 35% of the length of the common chamber.

22. The method of claim 19, wherein after passing through said outlet, said heat transfer fluid passes to a saturated vapor line.

* * * * *

UNITED STATES PATENT AND TRADEMARK OFFICE

CERTIFICATE OF CORRECTION

PATENT NO. : 6,581,398 B2
DATED : June 24, 2003
INVENTOR(S) : David A. Wightman

It is certified that error appears in the above-identified patent and that said Letters Patent is hereby corrected as shown below:

Title page,
Item [63], Related U.S. Application Data, delete "Continuation of application No. PCT/US00/00663, filed on Jan. 11, 2000, which is a continuation-in-part of application No. 09/228,696, filed on Jan. 12, 1999, now Pat. No. 6,185,958, which is a continuation-in-part of application No. 09/431,830, filed on Nov. 2, 1999, which is a continuation-in-part of application No. 09/443,071, filed Nov. 18, 1999."
and substitute -- This application is a continuation of application No. PCT/US00/00663, filed on Jan. 11, 2000, which is a continuation-in-part of application No. 09/431,830, filed Nov. 2, 1999, now Pat. No. 6,185,958; and a continuation-in-part of application No. 09/443,071, filed Nov. 18, 1999, now Pat. No. 6,644,052; which is a continuation-in-part of application No. 09/228,696, filed Jan. 12, 1999, now Pat. No. 6,314,747. -- in its place.

Signed and Sealed this

Thirteenth Day of April, 2004

JON W. DUDAS
*Acting Director of the United States Patent and Trademark Office*